US009097038B1

(12) United States Patent
Cohen

(10) Patent No.: US 9,097,038 B1
(45) Date of Patent: Aug. 4, 2015

(54) SLIDE LOCK DEVICE

(71) Applicant: Kevin M. Cohen, Tampa, FL (US)

(72) Inventor: Kevin M. Cohen, Tampa, FL (US)

( * ) Notice: Subject to any disclaimer, the term of this patent is extended or adjusted under 35 U.S.C. 154(b) by 104 days.

(21) Appl. No.: 13/650,567

(22) Filed: Oct. 12, 2012

Related U.S. Application Data

(60) Provisional application No. 61/627,578, filed on Oct. 14, 2011, provisional application No. 61/632,880, filed on Feb. 1, 2012.

(51) Int. Cl.
*E05C 1/02* (2006.01)
*E05B 65/08* (2006.01)
*E05C 1/04* (2006.01)

(52) U.S. Cl.
CPC ..... *E05B 65/087* (2013.01); *E05C 1/04* (2013.01); *Y10S 292/46* (2013.01)

(58) Field of Classification Search
CPC ... Y10S 292/46; Y10T 292/1022; E05C 1/04; E05C 7/045; E05B 65/087; E05B 65/0864
USPC ..... 292/DIG. 46, 137, 138, 145, 340, 292/DIG. 11, DIG. 63
See application file for complete search history.

(56) References Cited

U.S. PATENT DOCUMENTS 889,484 A 6/1908 Parker
1,397,934 A * 11/1921 Posson ..... 292/175
2,855,772 A 10/1958 Hingren
2,941,832 A 6/1960 Grossman
3,944,266 A * 3/1976 Weaver ..... 292/145
4,436,329 A 3/1984 Metzger
4,514,996 A 5/1985 Sjogren
4,530,531 A 7/1985 Mantini
5,152,561 A 10/1992 Engebretson
5,228,733 A 7/1993 Winters
5,284,371 A 2/1994 Richardson et al.
5,676,408 A 10/1997 Davidian
6,000,735 A 12/1999 Jourdenais
6,443,504 B1 9/2002 Donald
6,702,340 B2 3/2004 Donald
7,246,829 B1 7/2007 Balsbaugh et al.

* cited by examiner

*Primary Examiner* — Kristina Fulton
*Assistant Examiner* — Christine M Mills
(74) *Attorney, Agent, or Firm* — Frijouf, Rust & Pyle, P.A.

(57) ABSTRACT

A slide lock device is disclosed for preventing a panel from being displaced from an opening. The slide lock device comprises a latch plate and a mounting plate. A fastener traverses the latch plate and the mounting plate for slidably coupling the latch plate to a first side edge of the panel. A bolt extends from a lower edge of the latch plate. A bolt receiver is coupled to a first side structure of a surrounding structure. A lower stop surface of the mounting plate is adjacent to a lower termination surface of the latch plate for defining a non-locking position wherein the bolt may not engage with the bolt receiver for permitting displacement of the panel relative to the opening. An upper stop surface of the mounting plate is adjacent to an upper termination surface of the latch plate for defining a locking position therein the bolt engages with the bolt receiver upon the latch plate aligning with the bolt receiver for preventing the displacement of the panel relative to the opening.

13 Claims, 18 Drawing Sheets

SLIDE LOCK DEVICE

CROSS-REFERENCE TO RELATED APPLICATIONS

This application claims benefit of U.S. Patent Provisional application Ser. No. 61/627,578 filed Oct. 14, 2011. All subject matter set forth in provisional application Ser. No. 61/627,578 is hereby incorporated by reference into the present application as if fully set forth herein.

This application claims benefit of U.S. Patent Provisional application Ser. No. 61/632,880 filed Feb. 1, 2012. All subject matter set forth in provisional application Ser. No. 61/632,880 is hereby incorporated by reference into the present application as if fully set forth herein.

BACKGROUND OF THE INVENTION

1. Field of the Invention

This invention relates to locks and more particularly to the slide lock device.

2. Background of the Invention

Sliding doors have been used in buildings as early as the first century, as evidenced by archeological discoveries in Pompeii, Italy. In modern times sliding doors have evolved into two basic types, either mounted on a floor surface mounted track or suspended from an overhead mounted track. Sliding doors are now commonly used for glass and screen doors. The design of both types of sliding doors contains the same weakness, that of locking the sliding door. Various locks and locking systems have been devised, many have met with limited success. Most locking systems provide for relatively easy access to the sliding door locking mechanism from the interior of a structure and no access on the exterior side of the sliding door. Having a locking system with easy access from the interior side of the sliding door presents the problem of young children unlocking the door and exiting the building.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 889,484 to Parker discloses a pair of sliding sashes. A casing is secured to the upper rail of one of the sashes. A bolt is mounted to slide in the casing having at one end a pair of upwardly extending posts. The posts have outwardly inclined end portions. A headed member is located upon the other sash adapted to be received between the posts and be guided there between by the outwardly inclined portions. A locking screw is adapted to slide the bolt and lock the same in an extended or retracted position.

U.S. Pat. No. 2,855,772 to Hillgren discloses a lock for a sliding door having opposite faces and adapted to enter a slot in a door frame. The lock comprises a casing and a flange at an outside end thereof, a casing element in the casing, a cylinder lock having a key actuated rotatable plug for rotatably secured in the casing element, a separate housing and removable means securing the housing to the casing at a location on the side opposite the flange. The housing has a horizontal slot therein lying in a position diametrical with respect to the rotatable club. A locking bar has a barring end and securing means tiltably securing the bar to the housing in the slot. The bar has an unlocked position flush with the housing and a locking position with the barring end tilted outwardly of the housing. A camway is on a portion of the bar facing the rotatable plug and a cam on an end of the plug facing the bar rotatable to positions on the camway at locations on opposite sides of the securing means whereby to tilt the bar to locked and unlocked positions.

U.S. Pat. No. 2,941,832 to Grossman discloses a lock having a housing and a stop member mounted in the housing for movement between a retracted position within the housing and a position in which the member extends from the housing. Detent means are mounted on the stop member and engageable with a housing, when the stop member extends from the housing, to prevent shifting of the stop member to the retracted position. The detent means has a portion engageable with the housing, when the stop member extends from the housing, to retain the detent means on the stop member. A generally U-shaped spring are in the housing having rear and front arms. The rear arm engage the housing. The front arm engages the stop member to yieldably hold the stop member in its retracted and extended positions.

U.S. Pat. No. 3,944,266 to Weaver discloses a latch structure incorporating a housing and a bolt plate movable therein attachable to an edge of a sliding door adjacent a corner thereof where the bolt plate may move into registry with openings formed in a flanged track in which the sliding door moves. A fastener secures the housing to the edge of the door and a thumb screw engages the bolt plate through a slot in the housing to enable the bolt plate to be moved relative to the housing and secured in fixed position relative thereto.

U.S. Pat. No. 4,436,329 to Metzger discloses a novel locking mechanism for a sliding window or door of the type having an outer surrounding rectangular frame mounted to a wall, and an inner transparent pane mounted to a second rectangular frame slidably mounted within the outer frame. The locking mechanism is incorporated within one side of the inner frame and comprises a slide, a latch adapted to move and lock the slide, a deadbolt attached to the slide and adapted to extend into the outer frame to lock the two frames together, and a latch accessed through a latch port defined in the side of the inner frame. The latch port comprises a wider locking segment and a narrower adjacent unlocking segment, and the latch comprises a post attached to the slide and a button slidably mounted on the post and sized to extend through the wider locking segment of the latch port. A coil spring surrounding the post forces the button into the wider locking segment when the deadbolt is in the lock position, thus maintaining the latch and slide in a vibration-resistant configuration until the button is depressed through the wider locking segment and transported along the unlocking segment of the port.

U.S. Pat. No. 4,514,996 to Sjogren discloses a sliding door lock in which a bolt is longitudinally slidable by manual movement of a handle to which the bolt is connected so that the bolt is axially rotatable to prevent the cutting of the bolt when locked. The handle slides linearly along a base plate to move the bolt between opened and closed positions. A bullet latch in the handle engages detents on the base plate to hold the handle and bolt in the open and closed positions. A key-operated barrel lock has a barrel groove through which the bolt passes when the lock is in the unlocked position, and the bolt has a circumferential constriction which receives the barrel lock barrel when the barrel lock is rotated to its locked position, thereby preventing movement of the handle and bolt to the open position.

U.S. Pat. No. 4,530,531 to Mantini discloses a device for securing sliding closures such as a door or window slidable in an appropriate track in a frame. First and second latch sections are provided, one securable to the closure and the other securable to the frame by appropriate fasteners. The latch sections have complementary walls defining a substantially closed compartment which conceals the fasteners when the closure is in a closed position relative to the frame. The latch sections prevent the closure from being lifted out of the track.

U.S. Pat. No. 5,152,561 to Engebretson discloses a door handle and latch assembly for a sliding door comprising a main body having a finger gripping recess on one side facing outwardly to permit opening and closing of a sliding door and a latch member having an L-shaped bracket overlying a vertical edge of a door. The main body of the latch is located in a recess formed in the main body on the side opposite the side of the finger gripping recess. The recess is bounded also by a surface on the sliding door to form a channel in which the latch member can move up or down to lock and unlock the sliding door.

U.S. Pat. No. 5,228,733 to Winters discloses a safe and taper resistant safety lock system for the top of sliding glass doors and consists of a metal bracket fastened to the top edge of the door, positioned on the door with a screw which is normally found in each door, and then permanently fastened to the door with a second screw. A top, horizontal section, is formed by bending a first end of a metal plate, and extends over the top of the sliding door. The safety lock system is adjusted to reduce the gap between the top of the door and the top of the upper track to prevent lifting of the door out of the bottom track.

U.S. Pat. No. 5,284,371 to Richardson, et al. discloses a sliding door lock having a latch plate, which slidably engages a channel in one leg of a corner piece. The corner piece is mounted in a door frame. A stud is attached to the slider plate so that a person may grasp the stud and slide the plate up and down. The stud has internal threads. A small screw is threaded into the internal threads of the stud. The sliding door lock is used by grasping the stud, which extends through an elongated slot in the door frame, and using the stud to move the latch plate upward so that it extends past the top of the door frame. The small screw is then used to hold the latch plate in an upward position. A tool is used to thread the small screw past the end of the stud so that the end of the small screw is in frictional contact with the corner piece, thus holding the latch plate in the upward position. When the latch plate is locked in the upward position, the door cannot be slid open because the upper end of the plate will come into contact with a block positioned above the door frame and mounted on a supporting structure surrounding the door frame. The latch plate may also be used in conjunction with other blocks for the purpose of holding the sliding door open.

U.S. Pat. No. 5,676,408 to Davidian discloses a pocket door latch assembly has a housing with a latch arm pivotally mounted therewithin. The latch arm has a latch nose at one end and an inverted generally V-shaped slot adjacent its other end, and the arm is pivotable between a first position wherein it is entirely within the housing and a second position wherein the latch nose extends outwardly of the housing. An actuator has a portion slidable within the slot between a first position adjacent the one end of the arm and a second position spaced from the one end to pivot the latch arm between its first and second positions. The actuating means is manipulable outwardly of the housing to slide the slidable portion of the actuating means within the slot between its first and second positions, thereby pivoting the latch arm between its positions.

U.S. Pat. No. 6,000,735 to Jourdenais discloses a magnetically actuated safety lock device providing automatic locking capability to doors such as sliding glass patio doors and prevents unsupervised opening of the door by young children, thereby barring their access to dangerous environments. When the sliding door is closed, it is automatically locked. The lock device is installed in a position high upon the sliding door to prevent actuation by young children and requires no permanent modification to the door on which it is installed. The lock device consists of a locking assembly and a magnetic key. The locking assembly includes a magnetized latch assembly and a mounting bracket. The latch is held in the locked position by gravity and is only rotated into the unlocked position through the application of hand pressure or the repulsive force of the magnetic key. The doors can be unlocked from both inside and outside the door. Upon removal of either the magnetic force or hand pressure, the latch rotates back into the locked position. The latch is designed with an angled surface on one side such that as the user closes the door behind him, the door can close normally. This angled surface in the latch allows the door to slide along its track in the closing direction and, as the door edge touches the latch at the angled surface, the latch is rotated by the door into the unlocked position. Once the frame of the door slides completely past the latch, the latch rotates back into the locked position.

U.S. Pat. No. 6,443,504 to Donald discloses a sliding door latch with a finger pull mechanism that fits within a standardized aperture normally utilized for a hinged door latch. Provided is a latch assembly having an extendable latching hook for mounting in a sliding door and latching with a strike plate mounted in a door frame and a finger pull mechanism for accessing the sliding door from within a surrounding framework. Included are a housing assembly for fitting within the sliding door, an exposed edge plate mounted to the edge of the sliding door beside the housing assembly, a latching hook for engaging with the strike plate and extendable through the exposed edge plate, and a finger pull mechanism mounted in the edge plate.

U.S. Pat. No. 6,702,340 to Donald discloses a sliding door latch with a finger pull mechanism that fits within a standardized aperture normally utilized for a hinged door latch. Provided is a latch assembly having an extendable latching hook for mounting in a sliding door and latching with a strike plate mounted in a door frame and a finger pull mechanism for accessing the sliding door from within a surrounding framework. Included are a housing assembly for fitting within the sliding door, an exposed edge plate mounted to the edge of the sliding door beside the housing assembly, a latching hook for engaging with the strike plate and extendable through the exposed edge plate, and a finger pull mechanism mounted in the edge plate.

U.S. Pat. No. 7,246,829 to Balsbaugh, et al. discloses an improved sliding door latch comprising a latch plate attached to the leading edge of the door and projecting outwardly on either side of the door to enable a person to grasp the latch plate to slide the door open or closed, and a latch arm pivotally secured to the doorjamb and movable between a first unlocked position which permits the door to be opened or closed and a latched position engaging the latch plate and preventing movement of the door.

Although the aforementioned prior art have contributed to the development of the art of sliding door locks, none of these prior art patents have solved the needs of this art.

Therefore, it is an object of the present invention to provide an improved apparatus for locking a sliding door.

Another object of this invention is to provide an improved apparatus for preventing children from opening a locked sliding door.

Another object of this invention is to provide an improved apparatus that is simple for the adult operator to use.

Another object of this invention is to provide an improved apparatus that is easy to cost effectively produce.

Another object of this invention is to provide an improved apparatus that is easy to install on new or existing sliding door systems.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved slide lock device for preventing a panel from being displaced from an opening within a surrounding structure. The panel has an interior side, an exterior side, a top edge, a first side edge and a second side edge. The surrounding structure has a top structure, first side structure and a second side structure for defining the opening. A couple secures the panel to the surrounding structure for displacing the panel relative to the opening.

The slide lock device comprises a mounting plate having an interior plate surface, an exterior plate surface, an upper edge, a lower edge, a primary side surface and a secondary side surface. A guide track extends from the interior plate surface of the mounting plate and has an upper stop surface, a lower stop surface, a first side track surface and a second side track surface. A latch plate has an interior plate surface, an exterior plate surface, an upper edge, a lower edge, a primary side surface and a secondary side surface. A track groove extends between the interior plate surface of the latch plate and the exterior plate surface of the latch plate and has a upper termination surface, a lower termination surface, a first side groove surface and a second groove surface. A bolt extends from the lower edge of the latch plate. A bolt receiver is coupled to the first side structure of the surrounding structure. A fastener traverses the mounting plate, the track groove and into the first side edge of the panel for positioning the guide track into the track groove and slidably coupling the latch plate to the panel.

The lower stop surface of the guide track is adjacent to the lower termination surface of the track groove for defining a non-locking position wherein the bolt may not engage with the bolt receiver for permitting displacement of the panel relative to the opening. The upper stop surface of the guide track is adjacent to the upper termination surface of the track groove for defining a locking position therein the bolt engages with the bolt receiver upon the latch plate aligning with the bolt receiver for preventing the displacement of the panel relative to the opening.

The first side track surface of the guide track is adjacent to the first side groove surface of the track groove for defining a first slide guide. The second side track surface of the guide track is adjacent to the second side groove surface of the track groove for defining a second slide guide. The first slide guide and the second slide guide slidably channel the transition of the latch plate between the non-locking position and the locking position.

In a more specific embodiment of the invention, a first handle extends from the primary side surface of the latch plate for manipulating the latch plate between the non-locking position and the locking position from the interior side of the panel. A second handle extends from the secondary side surface of the latch plate for manipulating the latch plate between the non-locking position and the locking position from the exterior side of the panel.

In one embodiment of the invention, a spacer plate has an interior plate surface, an exterior plate surface, an upper edge, a lower edge, a primary side surface and a secondary side surface. The fastener traverses the mounting plate, the track groove, the spacer plate and into the first side edge of the panel for positioning the guide track into the track groove and slidably coupling the latch plate to the panel. The spacer plate distances the latch plate from the first side edge of the panel for defining an elongated slot therebetween.

In another embodiment of the invention, a latch recess extends from the exterior plate surface of the latch plate having an recess surface, an upper edge, a lower edge, a primary inner side surface and a secondary inner side surface. The latch recess receives the mounting plate for aligning the exterior plate surface of the latch plate with the exterior plate surface of the mounting plate and reducing the thickness of the slide lock device.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
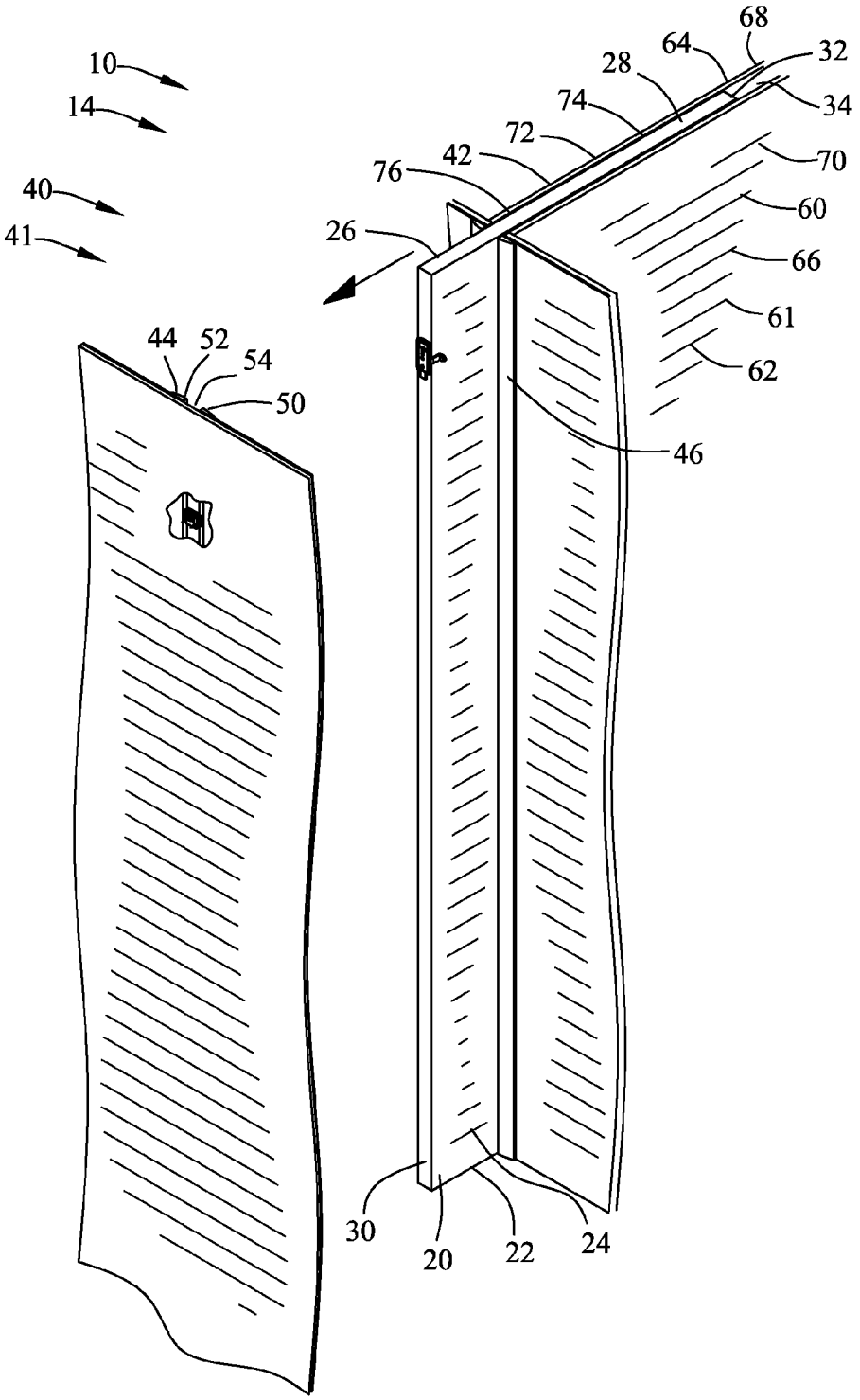
FIG. 1 is a front isometric view of a first embodiment of a slide lock device utilized with a pocket door system.

FIGS. 1-35 are various views of a slide lock device 10. The slide lock device 10 prevents a panel 20 from being displaced from an opening 40 within a surrounding structure 60 when the slide lock device 10 is in a locking position 12 as shown in FIGS. 3, 6, 7, 27 and 30. The slide lock device 10 permits the panel 20 to be displaced from an opening 40 within a surrounding structure 60 when the slide lock device 10 is in a non-unlocking position 14 as shown in FIGS. 1, 2, 4, 5, 25, 26, 28 and 29.

Figure 25:
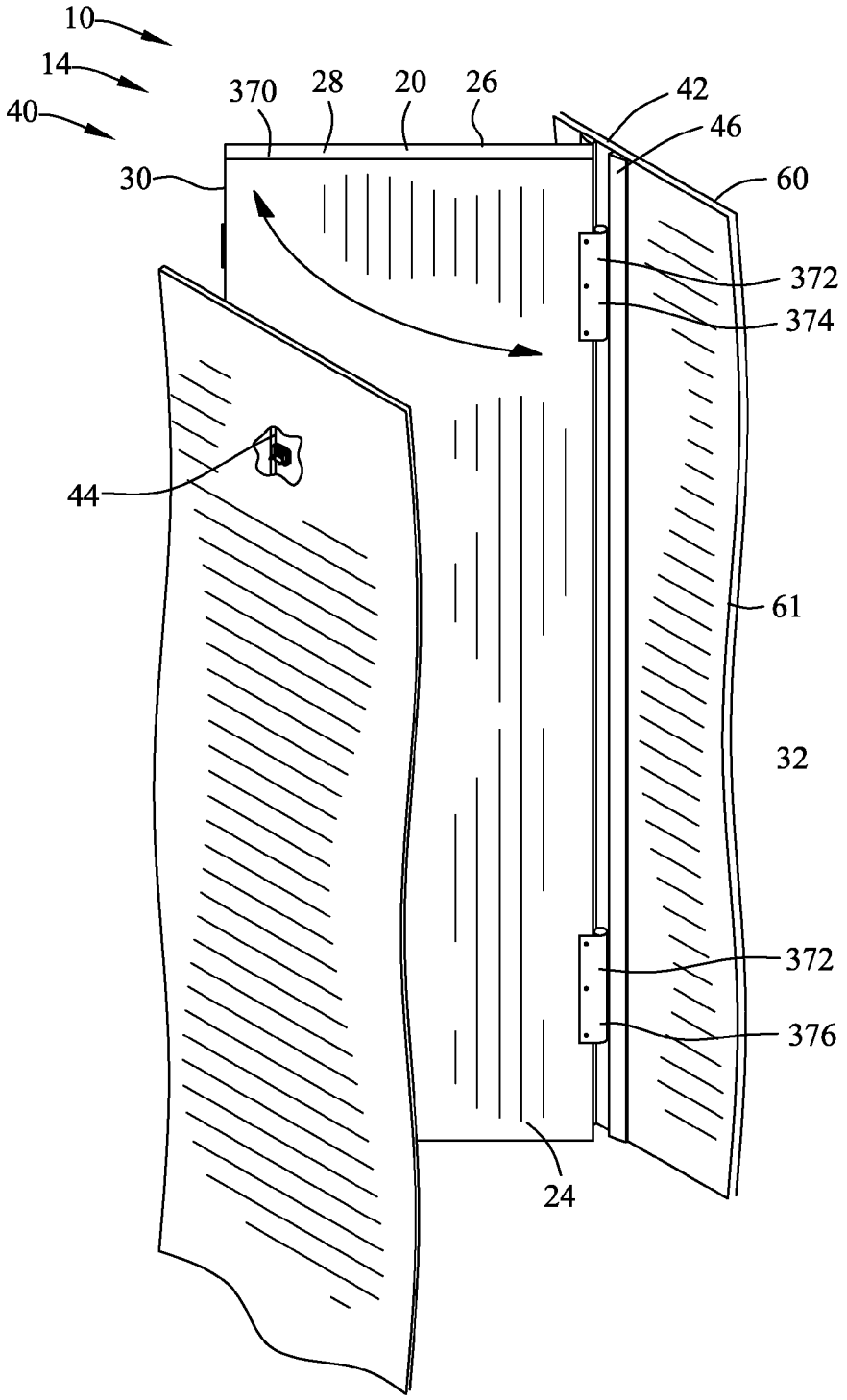
FIG. 25 is a front isometric view of a second embodiment of a slide lock device utilized with a swing door system.
Figure 28:
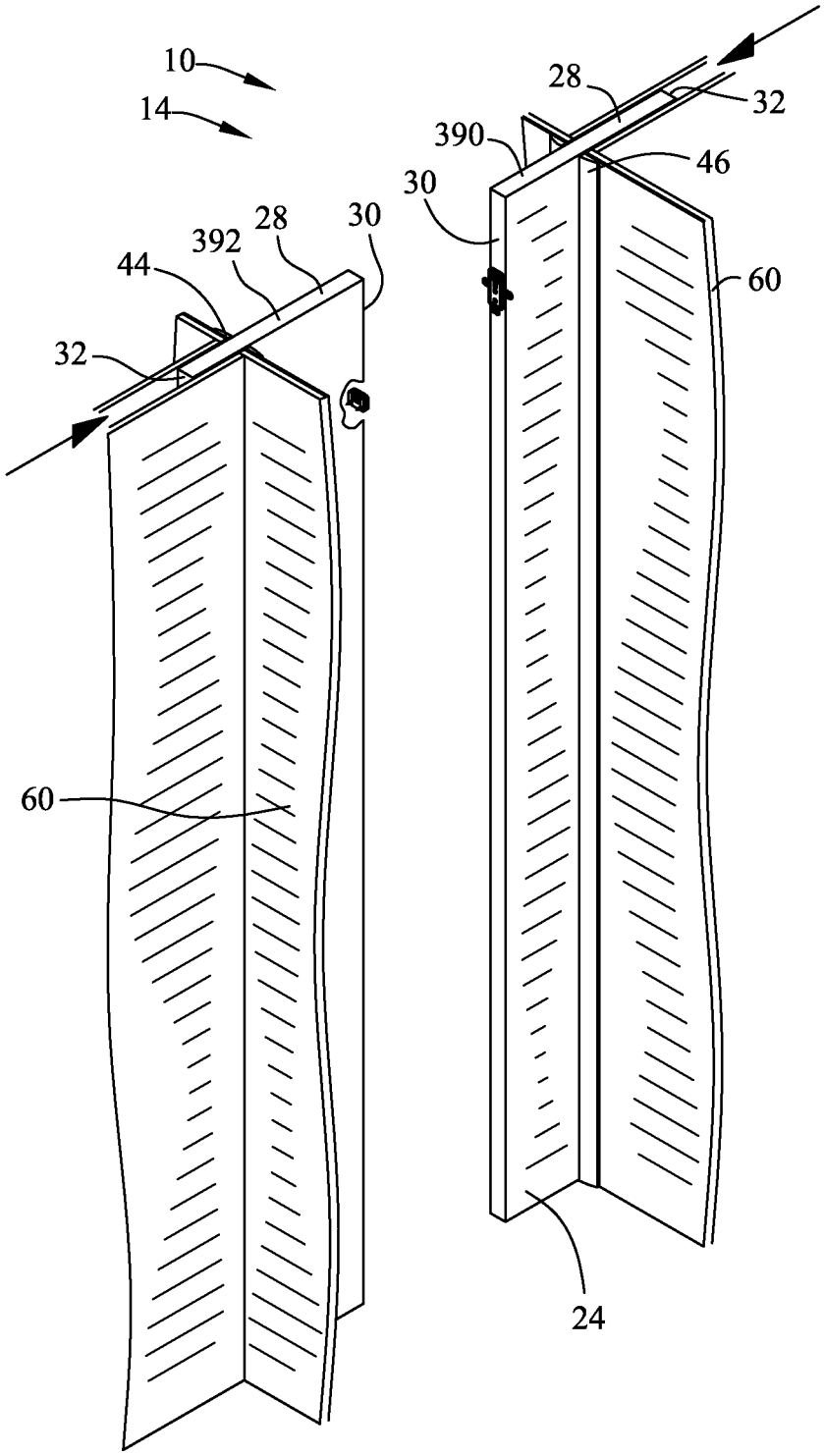
FIG. 28 is a front isometric view of the second embodiment of a slide lock device utilized with a double pocket door system.

The surrounding structure 60 is illustrated as a wall 61 in FIGS. 1, 25 and 28 and includes an interior wall side 62 and an exterior wall side 64. The wall 60 preferably is an interior wall 66 located within a building structure 70. The wall 60 may also include an exterior wall 68 located along the perimeter of the building structure 70. Alternatively, the surrounding structure 60 may include a cabinet, a glass enclosure or other structures suitable for supporting the panel 20. A couple 72 secures the panel 20 to the surrounding structure 60 for displacing the panel 20 relative to the opening 40.

The opening 40 within the wall 60 as shown in FIGS. 1-7 and 25-28 is illustrated as a door way 41 and is defined by a top jamb 42, first side jamb 44 and a second side jamb 46. As best shown in FIGS. 1-7, the first side jamb 44 has an interior jamb molding 50 and an exterior jamb molding 52 for defining a jamb elongated groove 54. The second side jamb 46 may similarly have an interior jamb molding 52 and an exterior jamb molding 54 for defining a jamb elongated groove 54.

As shown in FIGS. 1-7 and 26-30 the panel 20 includes a pocket door 22 that may be inserted within a pocket chamber 34 in the wall 60. Alternatively, the panel 20 may include a sliding panel, a pivoting panel, a rotating panel or other closure devices and may be constructed from wood, glass, metal or other materials. The pocket door 22 has an interior side 24, an exterior side 26, a top edge 28, a first side edge 30 and a second side edge 32. The couple 72 in FIGS. 1-7 and 26-30 may include one or more carriage(s) 74 slidably engaging with a carriage track 76. The carriages(s) 74 are fastened to the top edge 28 of the pocket door 22. The carriage track 76 is fastened to the top jamb 42 and extends within the pocket chamber 34.

A first embodiment of the slide lock device 10 is shown in FIGS. 1-24. The slide lock device 10 comprises a mounting plate 100 having an interior plate surface 102, an exterior plate surface 104, an upper edge 106, a lower edge 108, a primary side surface 110 and a secondary side surface 112. A guide track 120 extends from the interior plate surface 102 of the mounting plate 100 and has an upper stop surface 122, a lower stop surface 124, a first side track surface 126 and a second side track surface 128. The upper stop surface 122 may include an upper arc 130 and the lower stop surface 124 may include a lower arc 132. One or more fastener bores 134 traverse through the mounting plate 100 for receiving one or more fasteners 220, that will be discussed in more detail below. The mounting plate 100 may further include a key bore 136 extending from the interior plate surface 102 and into the mounting plate 100. The key bore 136 receives a key pin 316 that will be discussed in more detail below. The mounting plate 100 may be constructed from a polymeric, a metallic or other rigid materials.

The slide lock device 10 further includes a latch plate 150 having an interior plate surface 152, an exterior plate surface 154, an upper edge 156, a lower edge 158, a primary side surface 160 and a secondary side surface 162. A track groove 170 extending between the interior plate surface 152 of the latch plate 150 and the exterior plate surface 154 of the latch plate 150 and has an upper termination surface 172, a lower termination surface 174, a first side groove surface 176 and a second groove surface 178.

The upper termination surface 172 may include an upper arc 180 and the lower termination surface 174 may include a lower arc 182. The length and the radius of the upper arc 180 of the upper termination surface 172 is commensurate with the length and the radius of the upper arc 130 of the upper stop surface 122 for creating an upper continuous contact surface 184 between the upper termination surface 172 and the upper stop surface 122. Similarly, the length and the radius of the lower are 182 of the lower termination surface 174 is commensurate with the length and the radius of the lower arc 130 of the lower stop surface 124 for creating a lower continuous contact surface 186 between the lower termination surface 174 and the lower stop surface 124.

A bolt 200 extends from the lower edge 158 of the latch plate 150. The latch plate 150 and bolt 200 may be constructed from a unitary one piece and may be constructed from a polymeric, a metallic or other rigid materials.

A bolt receiver 210 is coupled between the exterior jamb molding 52 and the interior jamb molding 50 and within the jamb elongated groove 54 of the first side jamb 44. In order to couple the bolt receiver 210 to the first side jamb 44, the bolt receiver 210 may include one or more fastener bores 216 for receiving one or more receiver fasteners 218 that threadably engage in the first side jamb 44. Alternatively, the bolt receiver 210 may be coupled to the first side channel 44 by an adhesive, mechanical fasteners or other coupling devices. The bolt receiver 210 includes a bolt channel 214, which receives the bolt 200 that will be discussed in more detail below. The latch plate 150 and bolt 200 may be constructed from a unitary one piece and may be constructed from a polymeric, a metallic or other rigid materials.

A fastener 220 traversing the mounting plate 100, the track groove 170 and into the first side edge 30 of the pocket door 22 for positioning the guide track 120 into the track groove 170 and slidably coupling the latch plate 150 to the pocket door 22.

Figure 3:
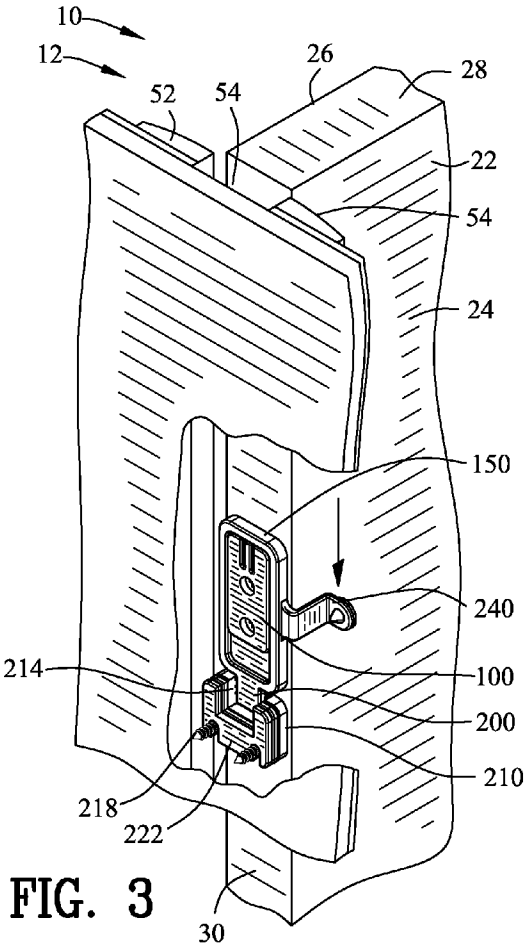
FIG. 3 is a view similar to FIG. 2, illustrating the upper stop surface of the guide track adjacent to the upper termination surface of the track groove for defining a locking position therein the bolt engages with the bolt receiver upon the latch plate aligning with the bolt receiver for preventing the displacement of the panel relative to the opening.
Figure 5:
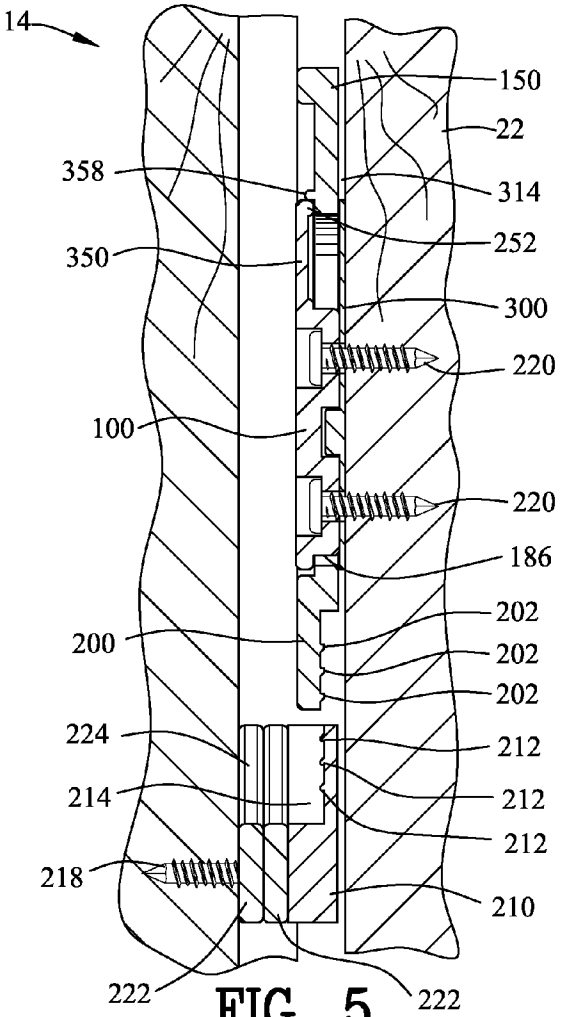
FIG. 5 is a sectional view along line 5-5 in FIG. 4.
Figure 4:
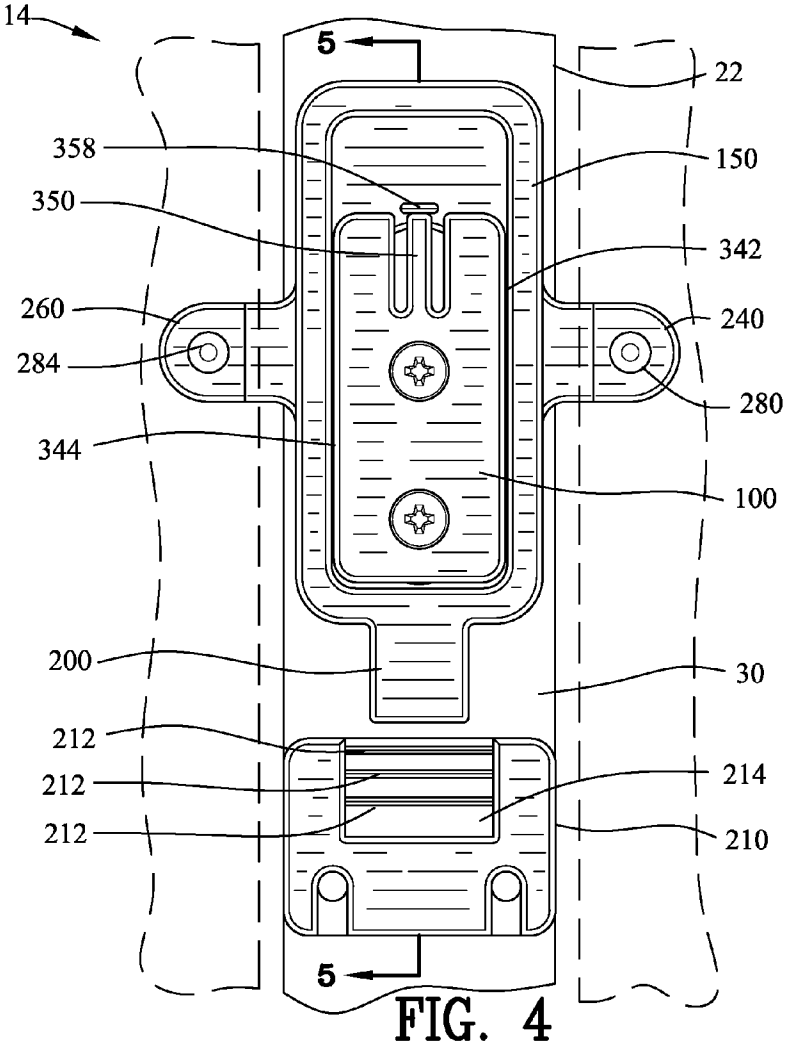
FIG. 4 is a front view of FIG. 2.
Figure 7:
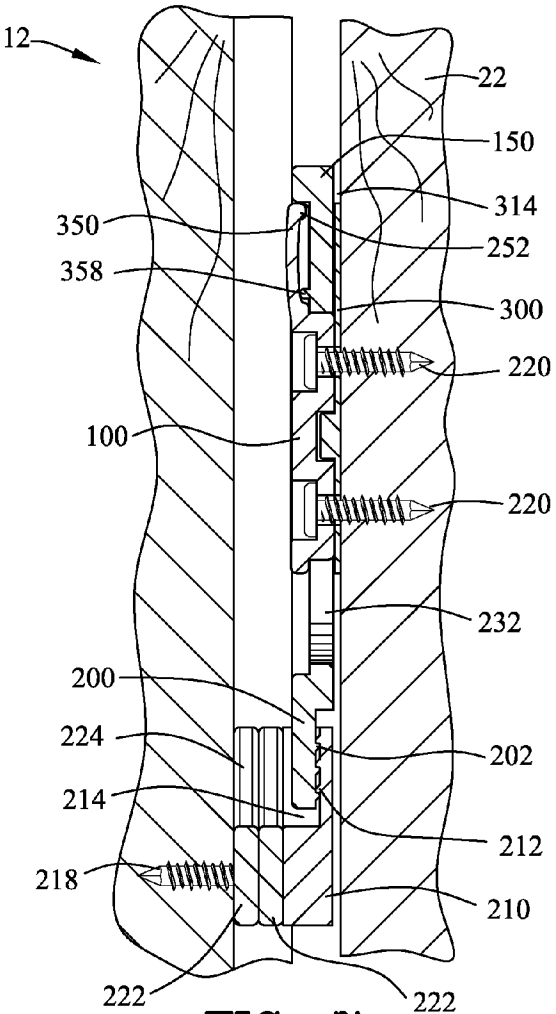
FIG. 7 is a sectional view along line 7-7 in FIG. 6.
Figure 6:
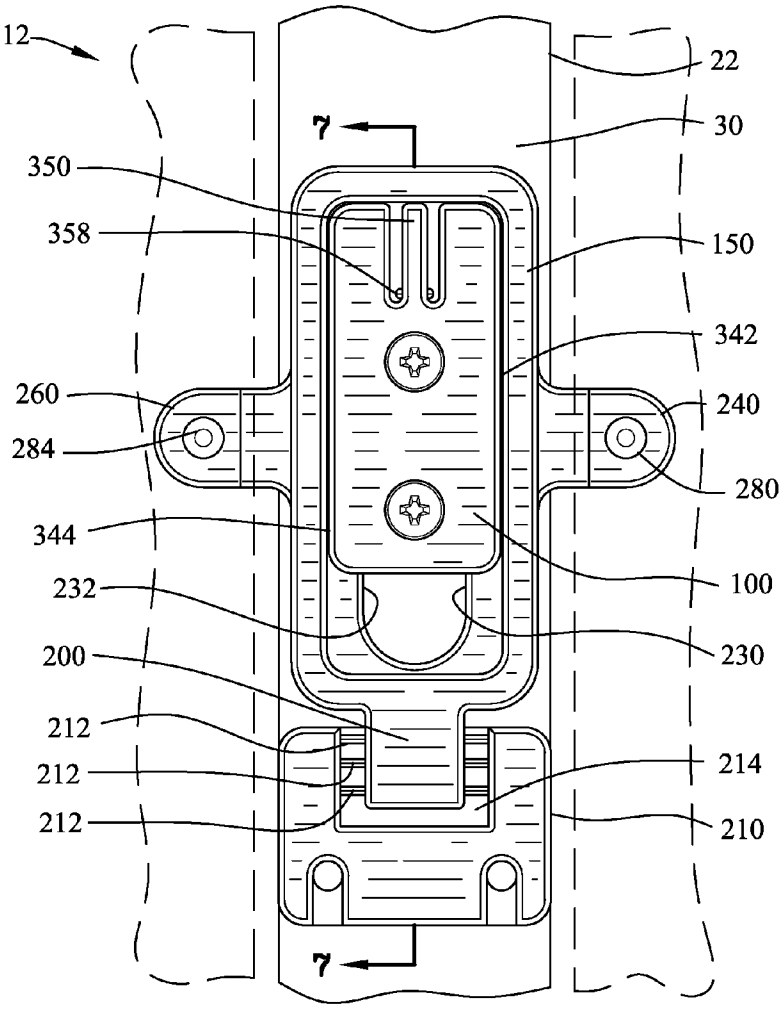
FIG. 6 is a front view of FIG. 3.
Figure 8:
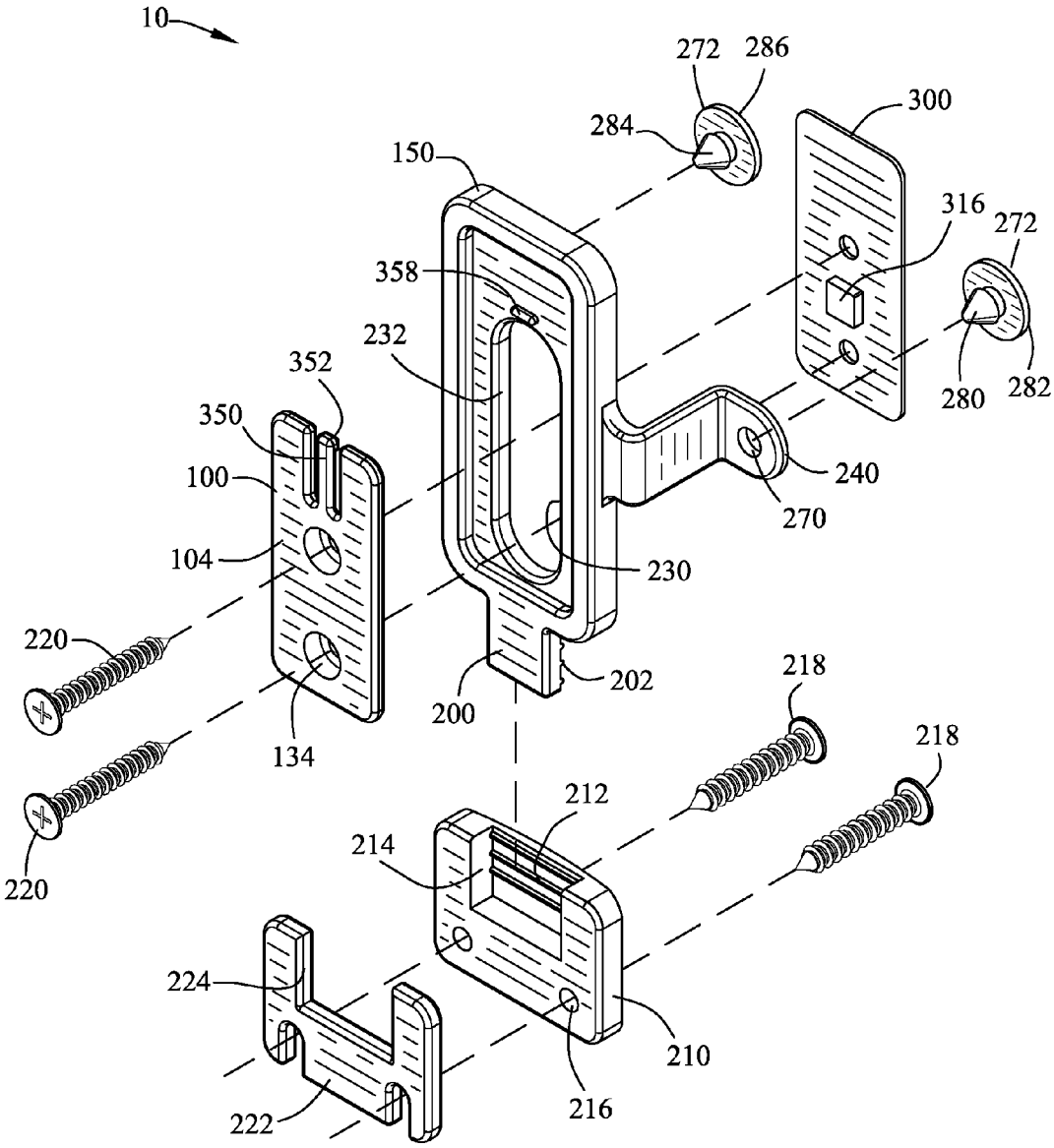
FIG. 8 is an exploded view of the slide lock device as shown in FIG. 3.
Figure 10:
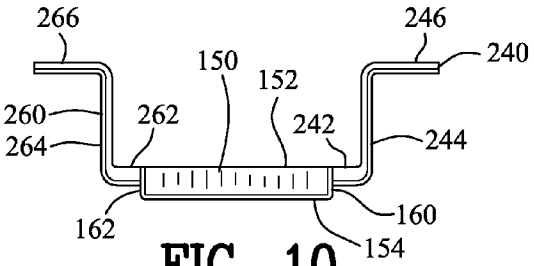
FIG. 10 is a top view of FIG. 9.
Figure 9:
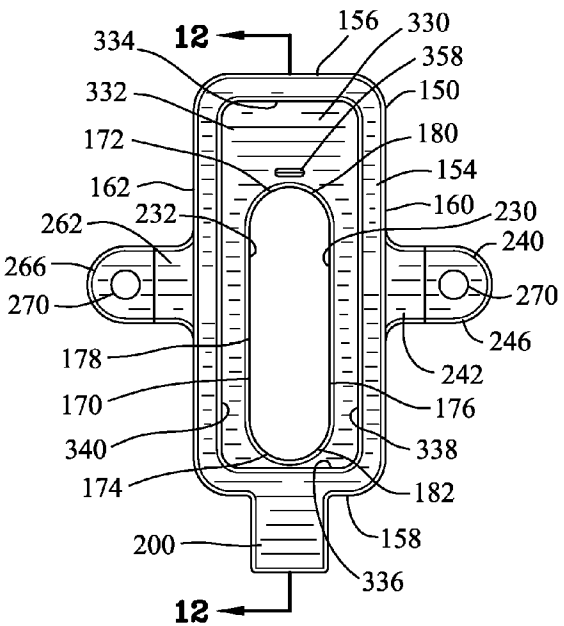
FIG. 9 is a front view of the latch plate as shown in FIG. 8.
Figure 11:
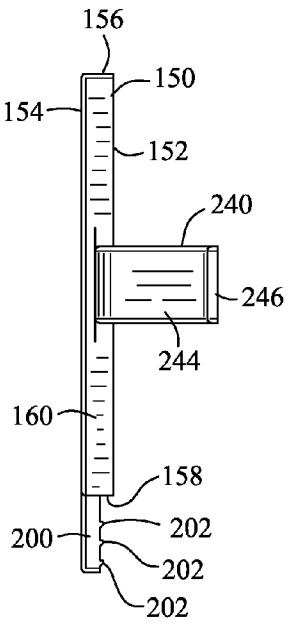
FIG. 11 is a right side view of FIG. 9.
Figure 12:
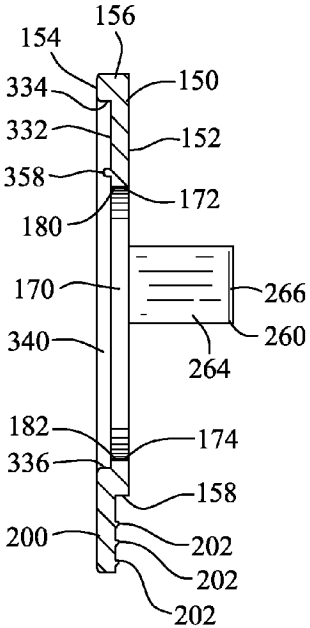
FIG. 12 is a sectional view along line 12-12 in FIG. 9.
Figure 13:
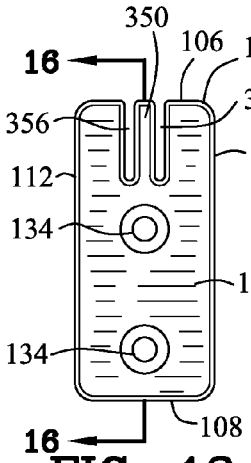
FIG. 13 is a front view of the mounting plate as shown in FIG. 8.
Figure 14:
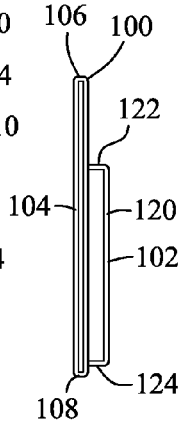
FIG. 14 is a right side view of FIG. 13.
Figure 15:
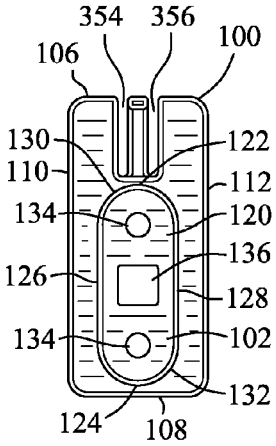
FIG. 15 is a rear view of FIG. 13.
Figure 16:
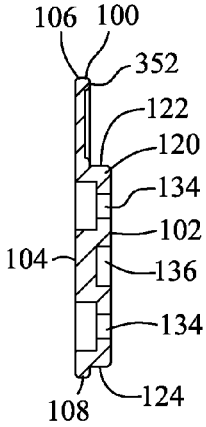
FIG. 16 is a sectional view along line 16-16 in FIG. 13.
Figure 17:
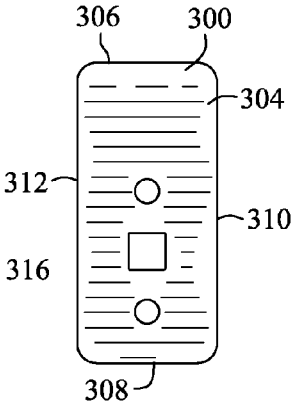
FIG. 17 is a front view of the spacer plate as shown in FIG. 8.
Figure 18:
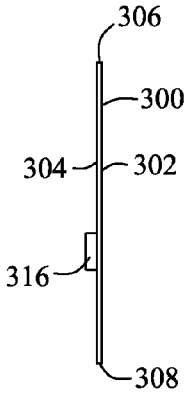
FIG. 18 is a right side view of FIG. 17.
Figure 19:
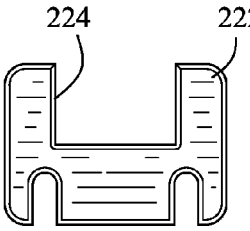
FIG. 19 is a front view of the bolt receiver spacer plate as shown in FIG. 8.
Figure 20:
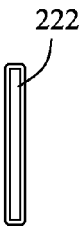
FIG. 20 is a right side view of FIG. 19.
Figure 22:
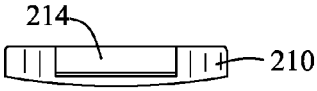
FIG. 22 is a top view of FIG. 21.
Figure 21:
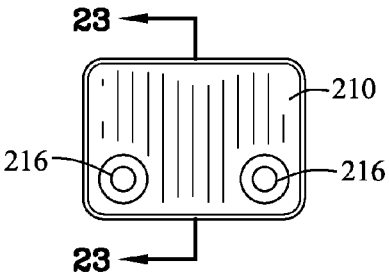
FIG. 21 is a front view of the bolt receiver as shown in FIG. 8.
Figure 23:
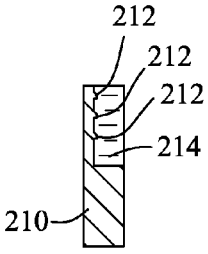
FIG. 23 is a sectional view along line 23-23 in FIG. 21.
Figure 24:
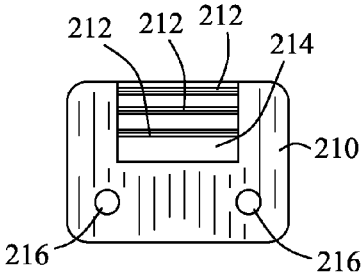
FIG. 24 is a rear view of FIG. 21.

As shown in FIGS. 1, 2, 4 and 5, the lower stop surface 124 of the guide track 120 is adjacent to the lower termination surface 174 of the track groove 170 for defining the non-locking position 14 wherein the bolt 200 may not engage with the bolt receiver 210 for permitting displacement of the pocket door 22 relative to the opening 40. As shown in FIGS. 3, 6 and 7, the upper stop surface 122 of the guide track 120 is adjacent to the upper termination surface 172 of the track groove 170 for defining the locking position 12 therein the bolt 200 engages with the bolt receiver 210 upon the latch plate 150 aligning with the bolt receiver 210 for preventing the displacement of the pocket door 22 relative to the opening 40.

The first side track surface 126 of the guide track 120 is adjacent to the first side groove surface 176 of the track groove 170 for defining a first slide guide 230. The second side track surface 128 of the guide track 120 is adjacent to the second side groove surface 178 of the track groove 170 for defining a second slide guide 232. The first slide guide 230 and the second slide guide 232 slidably channel the transition of the latch plate 150 between the non-locking position 14 and the locking position 12.

In order to manipulate the latch plate 150 from the interior side 24 of the pocket door 22, a first handle 240 extends from the primary side surface 160 of the latch plate 150 for manipulating the latch plate 150 between the non-locking position 14 and the locking position 12. The first handle 240 may further include a first extension portion 242 extending from the latch plate 150 and oriented parallel to the latch plate 150, a second extension portion 244 extending from the first extension portion 242 and oriented perpendicular to the latch plate 150 and a third extension portion 246 extending from the second extension portion 244 and oriented parallel to the latch plate 150. More specifically, the first extension portion 242 and the second extension portion 244 may define a 90° orientation. The second extension portion 244 and the third extension portion 246, may further define a 90° orientation. The first handle 240 may be constructed from a unitary one piece and may be constructed from a polymeric, a metallic or other rigid materials.

As shown in FIG. 3, the first extension portion 242 positions the first handle 240 beyond the first side edge 30 of the pocket door 22. The second extension portion 244 positions the first handle 240 beyond the interior jamb molding 50 of the first side jamb 44. The third extension portion 246 positions the first handle 240 beyond the interior side 24 of the pocket door 22. As such, the first extension portion 242, the second extension portion 244 and the third extension portion 246 permit manipulate the latch plate 150 wherein the latch plate 150 is concealed within the jamb elongated groove 54.

In order to further manipulate the latch plate 150 from the exterior side 26 of the pocket door 22, a second handle 260 extends from the secondary side surface 162 of the latch plate 150 for manipulating the latch plate 150 between the non-locking position 14 and the locking position 12. The second handle 260 includes a fourth extension portion 262 extending from the latch plate 150 and oriented parallel to the latch plate 150. A fifth extension portion 264 extends from the fourth extension portion 262 and oriented perpendicular to the latch plate 150. A sixth extension portion 266 extends from the fifth extension portion 264 and oriented parallel to the latch plate 150. More specifically, the fourth extension portion 262 and the fifth extension portion 264 may define a 90° orientation. The fifth extension portion 264 and the sixth extension portion 266, may further define a 90° orientation. The second handle 260 may be constructed from a unitary one piece and may be constructed from a polymeric, a metallic or other rigid materials.

As shown in FIG. 3, the fourth extension portion 262 positions the second handle 260 beyond the first side edge 30 of the pocket door 22. The fifth extension portion 264 positions the second handle 260 beyond the exterior jamb molding 52 of the first side jamb 44. The sixth extension portion 266 positions the second handle 260 beyond the exterior side 26 of the pocket door 22. As such, the fourth extension portion 262, the fifth extension portion 264 and the sixth extension portion 266 permit manipulate the latch plate 150 wherein the latch plate 150 is concealed within the jamb elongated groove 54.

The third extension portion 246 and the sixth extension portion 266 may have a pad bore 270 for receiving a cushioning material 272. More specifically, a first cushioning pad 280 and a second cushioning pad 282 may be positioned on opposing sides of the first handle 240 for reducing the impact force between the first handle 240 and the first side jamb 44 and the second side jamb 46 respectively. A third cushioning pad 284 and a fourth cushioning pad 286 may further be positioned on opposing sides of the second handle 260 for reducing the impact force between the second handle 260 and the first side jamb 44 and the second side jamb 46 respectively. The cushioning material to 72 may include a natural or non-natural elastomer, foam or other depressive old materials.

The slide lock device 10 further includes a spacer plate 300 has an interior plate surface 302, an exterior plate surface 304, an upper edge 306, a lower edge 308, a primary side surface 310 and a secondary side surface 312. The fastener 220 traverses the mounting plate 100, the track groove 170, the spacer plate 300 and into the first side edge 30 of the pocket door 22 for positioning the guide track 120 into the track groove 170 and slidably couples the latch plate 150 to the pocket door 22. The spacer plate 300 distances the latch plate 150 from the first side edge 30 of the pocket door 22 for defining an elongated slot 314 therebetween. The spacer plate 300 may further include the key pin 316 that extends above the spacer plate 300. The key pin 316 engages with the key bore 136 of the mounting plate 100 for maintaining the spacer plate 300 in alignment with the mounting plate 100. Furthermore, the spacer plate 300 may include fastener bores 134 that receive the fasteners 220 and further maintain the spacer plate 300 in alignment with the mounting plate 100. The spacer plate 300 may be constructed from a polymeric, a metallic or other rigid materials.

Preferably, the slide lock device 10 includes a latch recess 330 extending from the exterior plate surface 154 of the latch plate 150. The latch recess 330 has a recess surface 332, an upper edge 334, a lower edge 336, a primary inner side surface 338 and a secondary inner side surface 340. The latch recess 330 receiving the mounting plate 100 for aligning the exterior plate surface 154 of the latch plate 150 with the exterior plate surface 104 of the mounting plate 100 and reducing the thickness of the slide lock device 10.

The latch recess 330 further functions wherein the lower edge 108 of the mounting plate 100 is adjacent to the lower edge 336 of the latch recess 330 for positioning the latch plate 150 in the non-locking position 14. The upper edge 106 of the mounting plate 100 is adjacent to the upper edge 334 of the latch recess 330 for positioning the latch plate 150 in the locking position 12. In addition, the primary side surface 110 of the mounting plate 100 is adjacent to the primary inner side surface 338 of the latch recess 330 for defining a third slide guide 342. The secondary side surface 112 of the mounting plate 100 is also adjacent to the secondary inner side surface 340 of the latch recess 330 for defining a fourth slide guide 344. The third slide guide 342 and the fourth slide guide 344 slidably channel the transition of the latch plate 150 between the non-locking position 14 and the locking position 12.

The mounting plate 100 may include a preventer finger 350. The preventer finger 350 is constructed between a first channel 354 extending from the upper edge 106 and into the mounting plate 100 and a second channel 356 extending from the upper edge 106 and into the mounting plate 100. The distal end of the preventer finger 350 may include a raised retainer edge 358 that will be further discussed below. The preventer finger 350 is able to be displaced above the exterior plate surface 104 of the mounting plate 100. A finger rib 352 is coupled to the exterior plate surface 154 of the latch plate 150. The preventer finger 350 and the finger rib 352 are aligned such that they are capable of engaging one another upon the slidable engagement of the latch plate 150 relative to the mounting plate 100. More specifically, the preventer finger 350 when positioned below and adjacent to the finger rib 352 in the non-locking position 14 prevents inadvertent contact between the upper stop surface 122 of the guide track 120 and the upper termination surface 172 of the track groove 170. The preventer finger 350 may only pass over the finger rib 352 upon a descending force applied to the latch plate 150 for positioning the latch plate 150 in the locking position 12.

Figure 2:
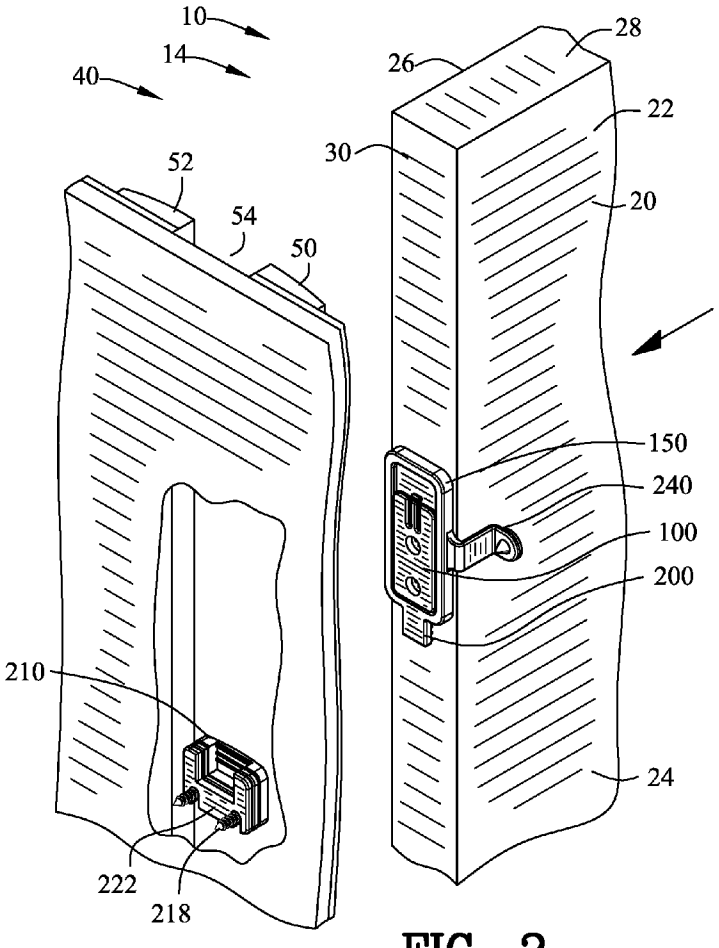
FIG. 2 is an enlarged view of FIG. 1, illustrating the lower stop surface of the guide track adjacent to the lower termination surface of the track groove for defining a non-locking position wherein the bolt may not engage with the bolt receiver for permitting displacement of the panel relative to the opening.

A bolt rib 202 is coupled to the bolt 200. A receiver rib 212 is coupled to said bolt receiver 210. The bolt rib 202 passing over the receiver rib 212 in the locking position 12 for preventing inadvertent removal of said bolt 200 from the bolt receiver 210. A bolt receiver spacer 222 having a second bolt channel 224 may be positioned between the bolt receiver 210 and the first side jamb 44 for increasing the depth of the bolt channel 214 as best shown in FIGS. 2 and 5.

FIGS. 25-27 and 31-35 illustrate a second embodiment of the slide lock device 10 utilized with a swing door 370. The slide lock device 10 prevents the swing door 370 from being displaced from the opening 40 within a wall 61. The swing door 370 has an interior side 24, an exterior side 26, a top edge 28, a first side edge 30 and a second side edge 32. A pivot 374 or a first hinge 374 and a second hinge 376 may secure the swing door 370 to the surrounding structure 60 or the second side jamb 46 for pivotably displacing the swing door 370 relative to the opening 40.

Figure 27:
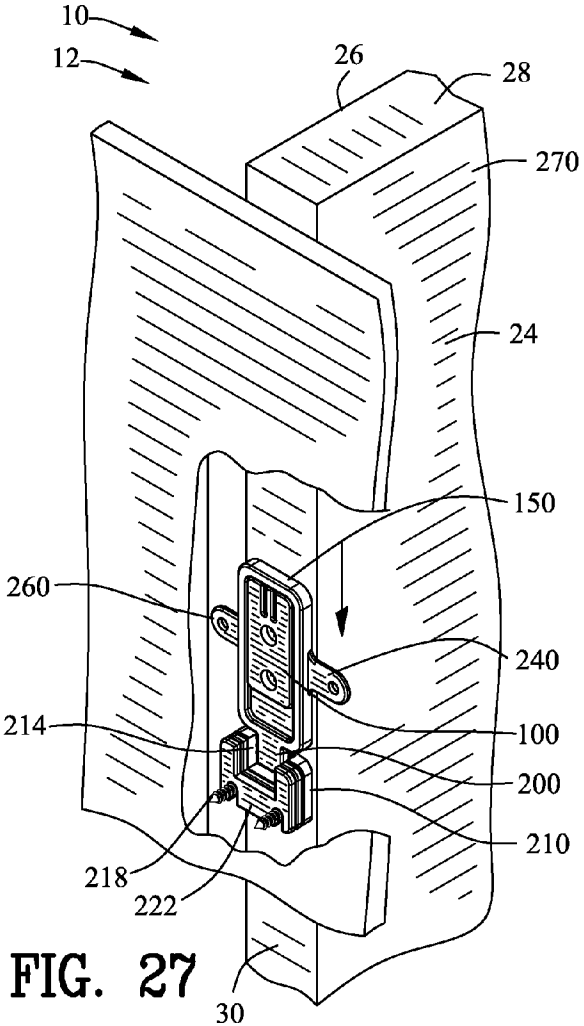
FIG. 27 is a view similar to FIG. 26, illustrating the upper stop surface of the guide track adjacent to the upper termination surface of the track groove for defining a locking position therein the bolt engages with the bolt receiver upon the latch plate aligning with the bolt receiver for preventing the displacement of the panel relative to the opening.
Figure 26:
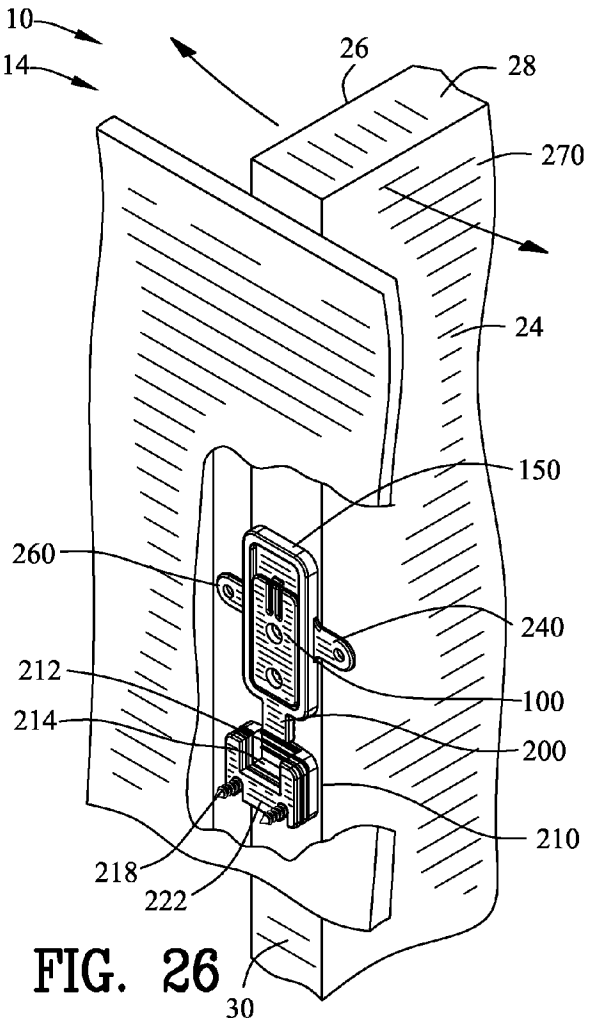
FIG. 26 is an enlarged view of FIG. 25, illustrating the lower stop surface of the guide track adjacent to the lower termination surface of the track groove for defining a non-locking position wherein the bolt may not engage with the bolt receiver for permitting displacement of the panel relative to the opening.
Figure 31:
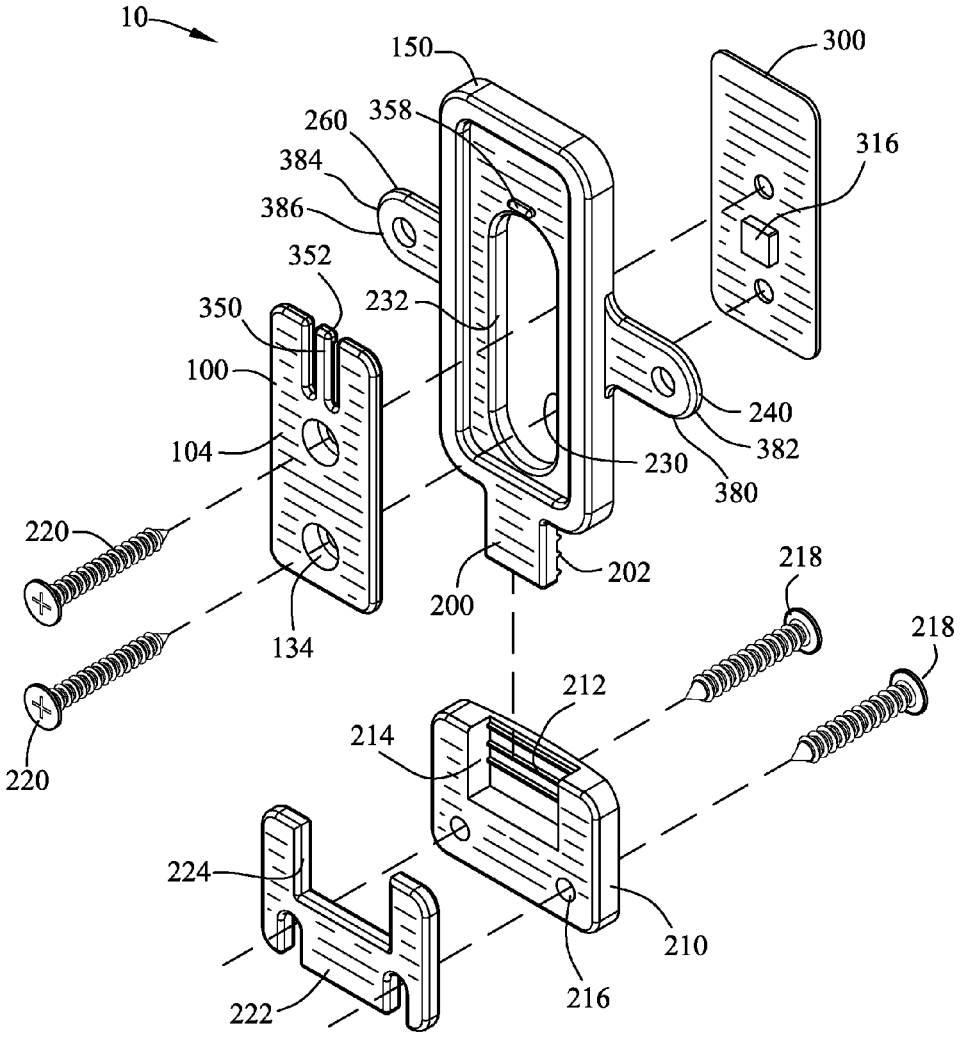
FIG. 31 is an exploded view of the slide lock device as shown in FIG. 25.
Figure 33:
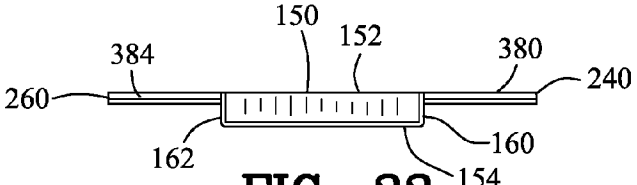
FIG. 33 is a top view of FIG. 32.
Figure 32:
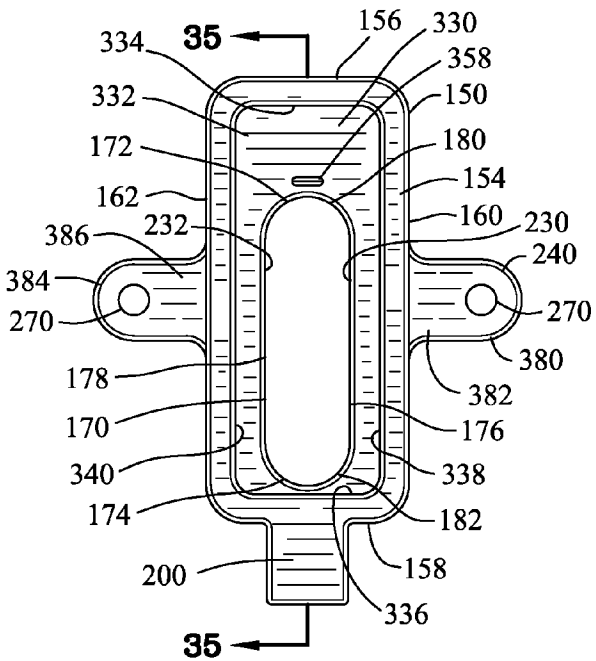
FIG. 32 is a front view of the latch plate as shown in FIG. 31.
Figure 34:
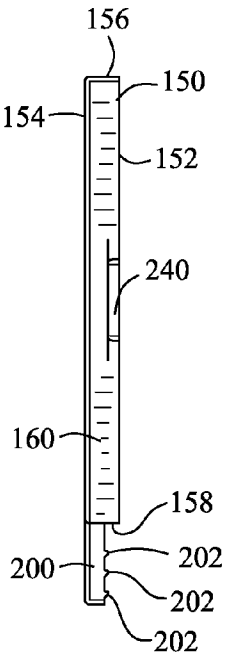
FIG. 34 is a right side view of FIG. 32.
Figure 35:
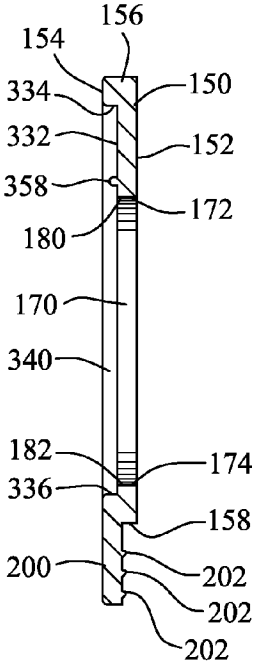
FIG. 35 is a sectional view along line 35-35 in FIG. 32.

Similar to the FIGS. 1-24 and as shown in FIGS. 26, 27 and 31, the fastener 220 traverses the mounting plate 100, the track groove 170 and into the first side edge 30 of the swing door 370 for positioning the guide track 120 into the track groove 170 and slidably coupling the latch plate 150 to the swing door 370.

The bolt receiver 210 is coupled to the first side jamb 44. In order to couple the bolt receiver 210 to the first side jamb 44, the bolt receiver 210 may include one or more fastener bores 216 for receiving one or more receiver fasteners 218 that threadably engage in the first side jamb 44.

As illustrated in FIG. 26, the lower stop surface 124 of the guide track 120 is adjacent to the lower termination surface 174 of the track groove 170 for defining the non-locking position 14 wherein the bolt 200 may not engage with the bolt receiver 210 and permit displacement of the swing door 370 relative to the opening 40. As illustrated in FIG. 27, the upper stop surface 122 of the guide track 120 is adjacent to the upper termination surface 172 of the track groove 170 for defining the locking position 12 therein the bolt 200 may engage with the bolt receiver 210 upon the latch plate 150 aligning with the bolt receiver 210 and preventing the displacement of the swing door 370 relative to the opening 40.

In order to manipulate the latch plate 150 from the interior side 24 of the swing door 370, a primary handle 380 extends from the primary side surface 160 of the latch plate 150 for manipulating the latch plate 150 between the non-locking position 14 and the locking position 12. The primary handle 380 consists of a first linear extension portion 382 extending from the latch plate 150 and oriented parallel to the latch plate 150. More specifically, the first linear extension portion 382 may be positioned in the same plane as the latch plate 150. The first linear extension portion 382 and the latch plate 150 may be constructed from a unitary one piece and may be constructed from a polymeric, a metallic or other rigid materials.

As shown in FIGS. 26 and 27, the first linear extension portion 382 positions the primary handle 380 beyond the first side edge 30 of the swing door 370. As such, the first linear extension portion 382 permits manipulate the latch plate 150 wherein the latch plate 150 is concealed between the first side edge 30 of the swing door 370 and the surrounding structure 60.

In order to further manipulate the latch plate 150 from the exterior side 26 of the swing door 370, a secondary handle 384 extends from the secondary side surface 162 of the latch plate 150 for manipulating the latch plate 150 between the non-locking position 14 and the locking position 12. The secondary handle 384 consists of a second linear extension portion 386 extending from the latch plate 150 and oriented parallel to the latch plate 150. More specifically, the second linear extension portion 386 may be positioned in the same plane as the latch plate 150. The second linear extension portion 386 and the latch plate 150 may be constructed from a unitary one piece and may be constructed from a polymeric, a metallic or other rigid materials.

As shown in FIGS. 26 and 27, the second linear extension portion 386 positions the secondary handle 384 beyond the second side edge 32 of the swing door 370. As such, the second linear extension portion 386 permits manipulate the latch plate 150 wherein the latch plate 150 is concealed between the first side edge 30 of the swing door 370 and the surrounding structure 60.

FIGS. 28-35 illustrate a second embodiment of the slide lock device 10 utilized with a first pocket door 390 and a second pocket door 392. The slide lock device 10 couples the first pocket door 390 with the second pocket door 392 for preventing the first pocket door 390 and the second pocket door 392 from being displaced from the opening 40 within a wall 61.

Figure 30:
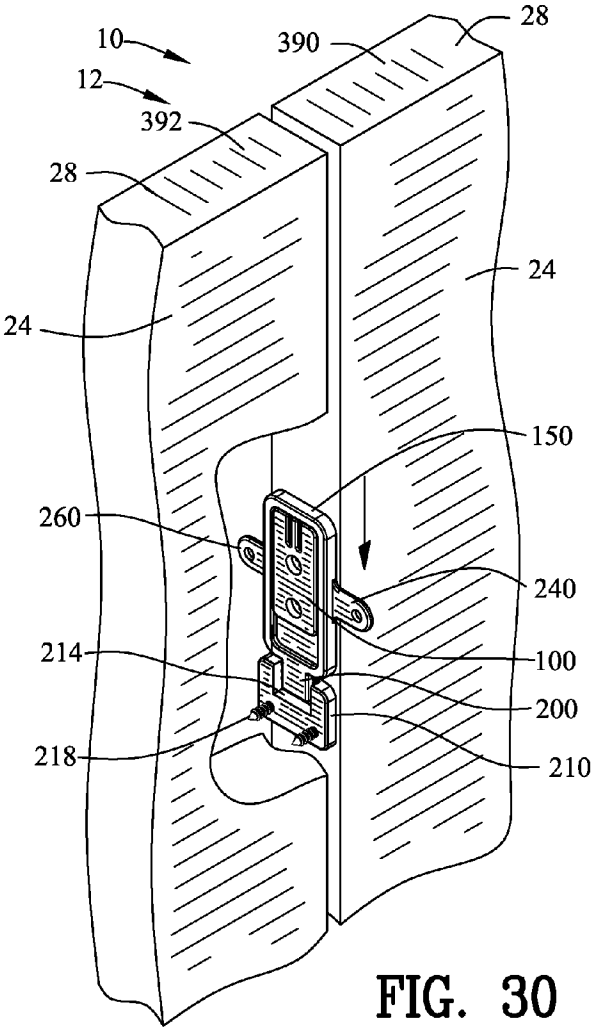
FIG. 30 is a view similar to FIG. 29, illustrating the upper stop surface of the guide track adjacent to the upper termination surface of the track groove for defining a locking position therein the bolt engages with the bolt receiver upon the latch plate aligning with the bolt receiver for preventing the displacement of the panel relative to the opening.
Figure 29:
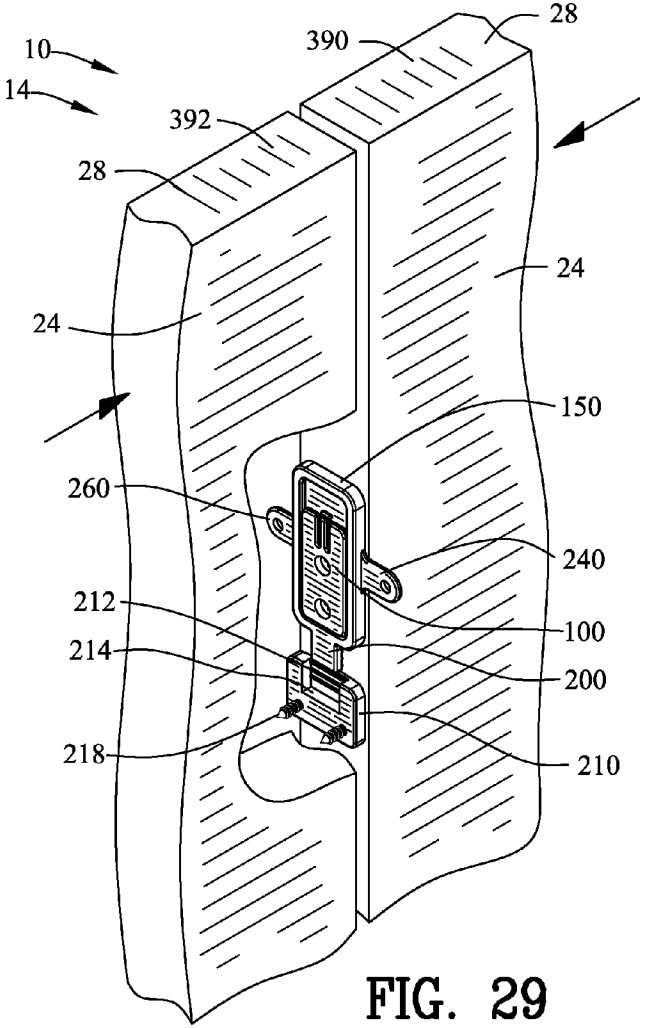
FIG. 29 is an enlarged view of FIG. 28, illustrating the lower stop surface of the guide track adjacent to the lower termination surface of the track groove for defining a non-locking position wherein the bolt may not engage with the bolt receiver for permitting displacement of the panel relative to the opening.

Similar to the FIGS. 1-24 and as shown in FIGS. 28-30, the fastener 220 traverses the mounting plate 100, the track groove 170 and into the first side edge 30 of the first pocket door 390 for positioning the guide track 120 into the track groove 170 and slidably coupling the latch plate 150 to the first pocket door 390.

The bolt receiver 210 is coupled to the first side edge 30 of the second pocket door 392. In order to couple the bolt receiver 210 to the first side edge 30 of the second pocket door 392, the bolt receiver 210 may include one or more fastener bores 216 for receiving one or more receiver fasteners 218 that threadably engage in the first side edge 30 of the second pocket door 392.

As illustrated in FIG. 29, the lower stop surface 124 of the guide track 120 is adjacent to the lower termination surface 174 of the track groove 170 for defining the non-locking position 14 wherein the bolt 200 may not engage with the bolt receiver 210 and permit displacement of the first pocket door 390 relative to the second pocket door 392. As illustrated in FIG. 30, the upper stop surface 122 of the guide track 120 is adjacent to the upper termination surface 172 of the track groove 170 for defining the locking position 12 therein the bolt 200 may engage with the bolt receiver 210 upon the latch plate 150 aligning with the bolt receiver 210 and preventing the displacement of the first pocket door 390 relative to the second pocket door 392.

In order to manipulate the latch plate 150 from the interior side 24 of the first pocket door 390 and the second pocket door 392, a primary handle 380 extends from the primary side surface 160 of the latch plate 150 for manipulating the latch plate 150 between the non-locking position 14 and the locking position 12. The primary handle 380 consists of a first linear extension portion 382 extending from the latch plate 150 and oriented parallel to the latch plate 150. More specifically, the first linear extension portion 382 may be positioned in the same plane as the latch plate 150. The first linear extension portion 382 and the latch plate 150 may be constructed from a unitary one piece and may be constructed from a polymeric, a metallic or other rigid materials.

As shown in FIGS. 29 and 30, the first linear extension portion 382 positions the primary handle 380 beyond the first pocket door 390 and the second pocket door 392. As such, the first linear extension portion 382 permits manipulate the latch plate 150 wherein the latch plate 150 is concealed between the first side edge 30 of the first pocket door 390 and the second pocket door 392.

In order to further manipulate the latch plate 150 from the exterior side 26 of the first pocket door 390 and the second pocket door 392, a secondary handle 384 extends from the secondary side surface 162 of the latch plate 150 for manipulating the latch plate 150 between the non-locking position 14 and the locking position 12. The secondary handle 384 consists of a second linear extension portion 386 extending from the latch plate 150 and oriented parallel to the latch plate 150. More specifically, the second linear extension portion 386 may be positioned in the same plane as the latch plate 150. The second linear extension portion 386 and the latch plate 150 may be constructed from a unitary one piece and may be constructed from a polymeric, a metallic or other rigid materials.

As shown in FIGS. 29 and 30, the second linear extension portion 386 positions the secondary handle 384 beyond the second side edge 32 of the first pocket door 390 and the second pocket door 392. As such, the second linear extension portion 386 permits manipulate the latch plate 150 wherein the latch plate 150 is concealed between the first side edge 30 of the first pocket door 390 and the second pocket door 392.

FIGS. 36-48 illustrate a third embodiment of the slide lock device 10. FIGS. 36-44 are similar views of FIGS. 8-16 respectively and FIGS. 45-48 are similar views of FIGS. 4-7 respectively. The structure of the third embodiment as shown in FIGS. 36-48 is similar to the structure of the first embodiment as shown in FIGS. 1-24 with some modifications. More specifically, the third embodiment includes a first strengthening brace 248 extending between the second extension portion 244 and the third extension portion 246 of the first handle 240. Similarly, a second strengthening brace 268 extends between the fifth extension portion to 264 and the sixth extension portion 266 of the second handle 260. The first strengthening brace 248 and the second strengthening brace strengthens the first handle 240 and a second handle 260 respectively and prevents yielding between the second extension portion 244 and the third extension portion 246, and between the fifth extension portion 264 and the six extension portion 266 respectively.

Figure 36:
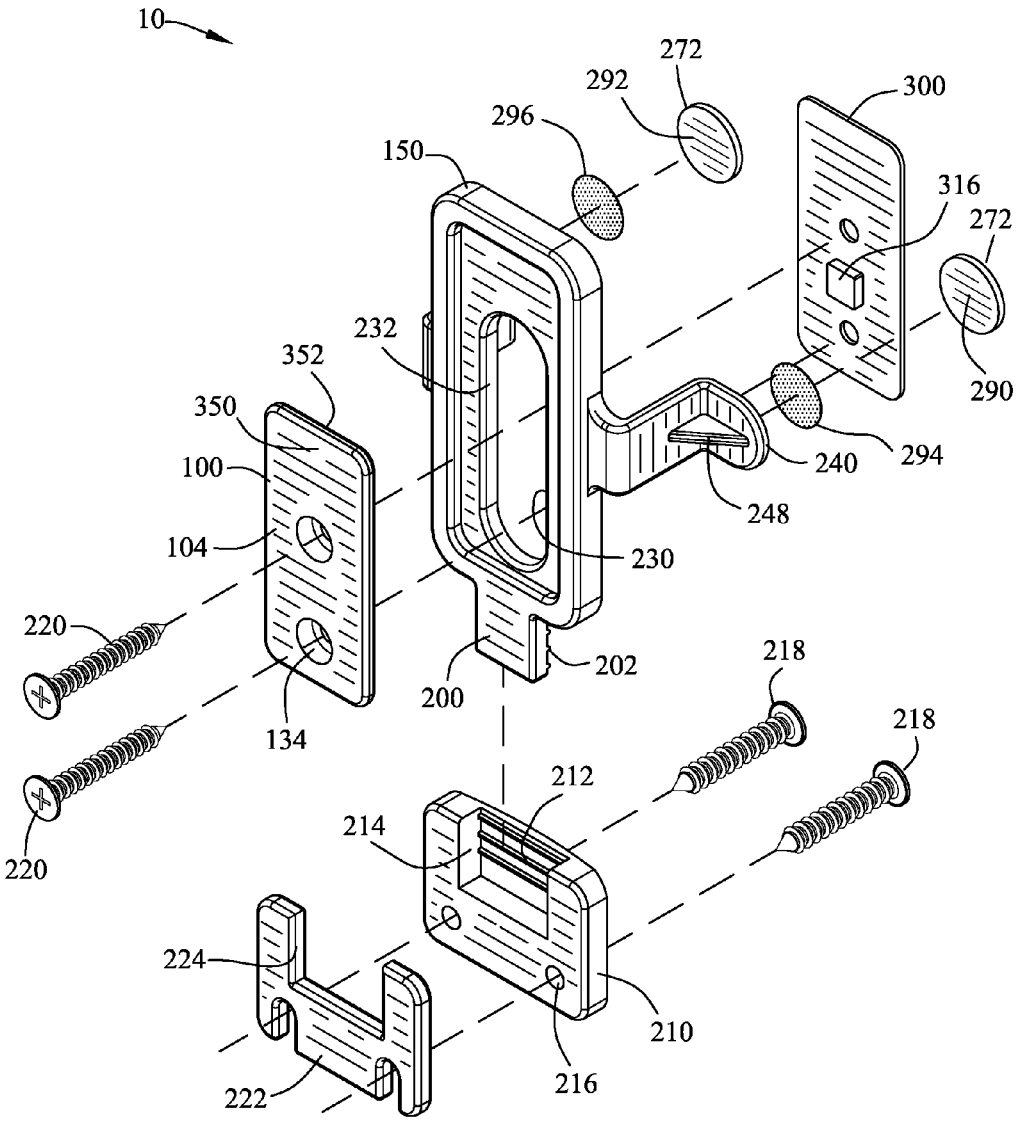
FIG. 36 is an exploded view of a third embodiment of the slide lock device that can be utilized on a pocket door.
Figure 38:
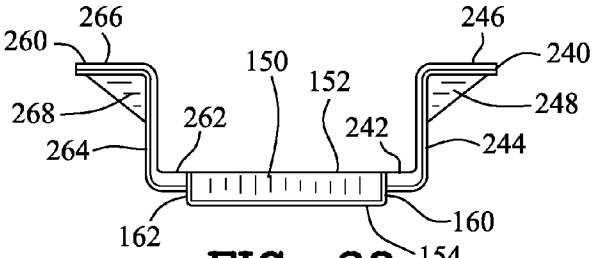
FIG. 38 is a top view of FIG. 37.
Figure 37:
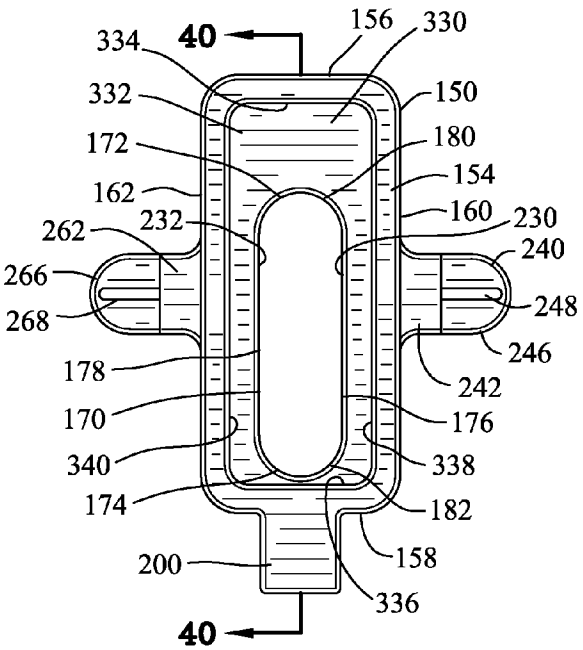
FIG. 37 is a front view of the latch plate as shown in FIG. 36.
Figure 39:
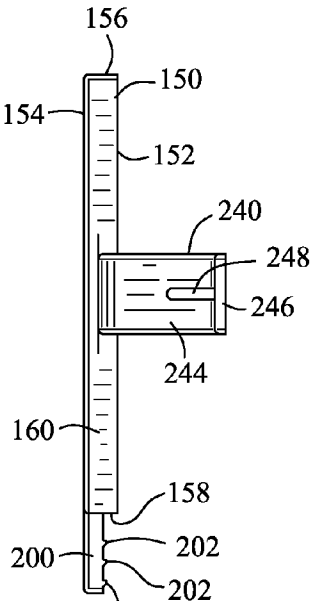
FIG. 39 is a right side view of FIG. 37.
Figure 40:
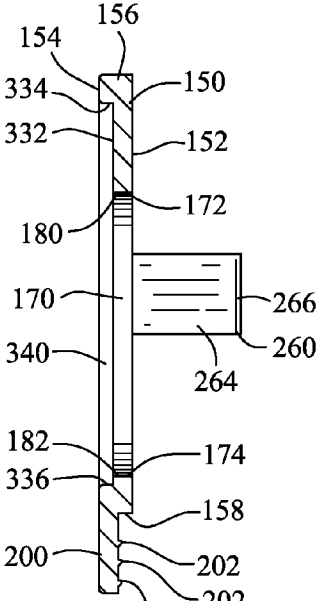
FIG. 40 is a sectional view along line 40-40 in FIG. 37.
Figures 41, 42, 43, 44:
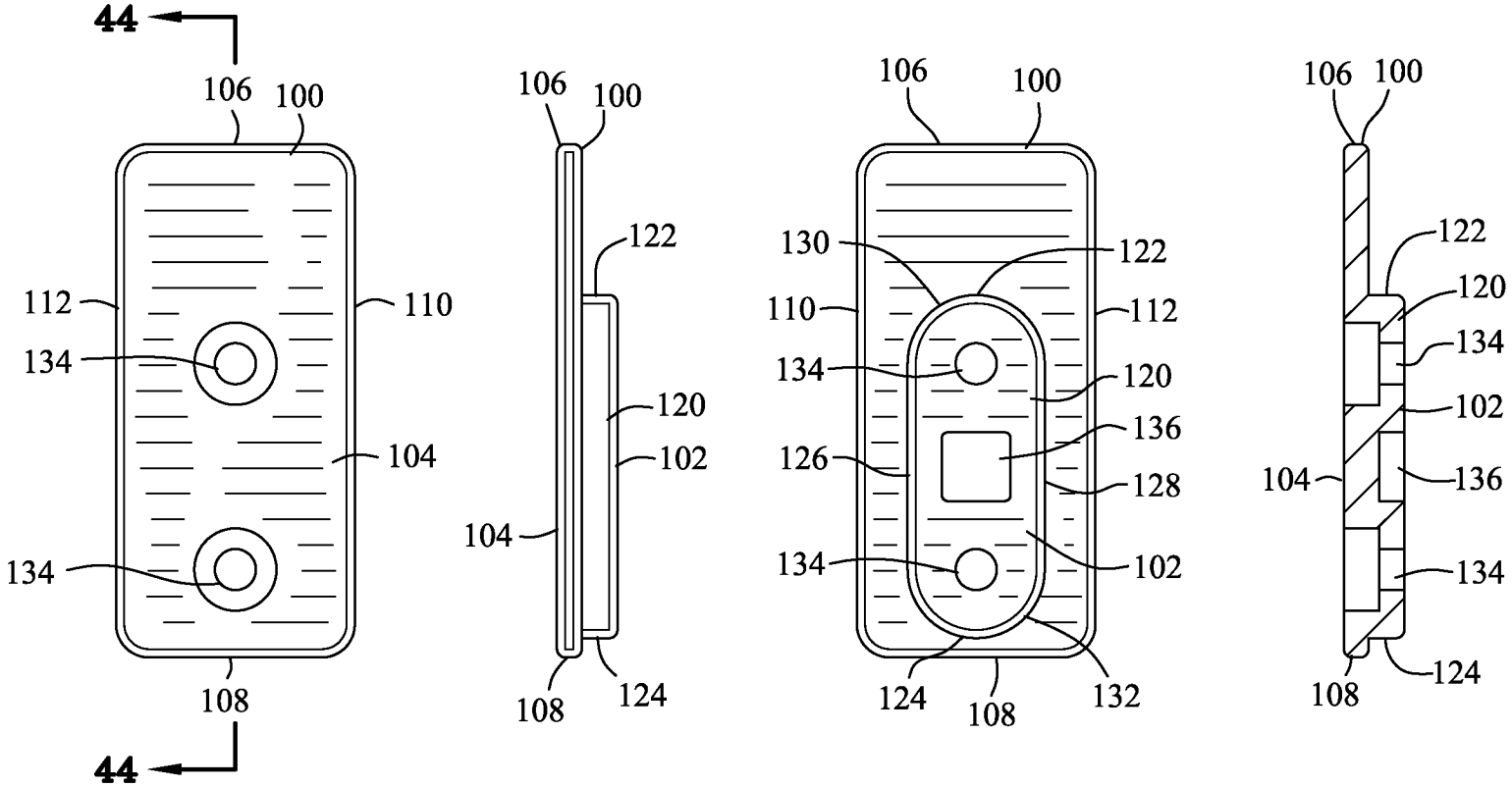
FIG. 41 is a front view of the mounting plate as shown in FIG. 36.
FIG. 42 is a right side view of FIG. 41.
FIG. 43 is a rear view of FIG. 41.
FIG. 44 is a sectional view along line 44-44 in FIG. 41.
Figure 46:
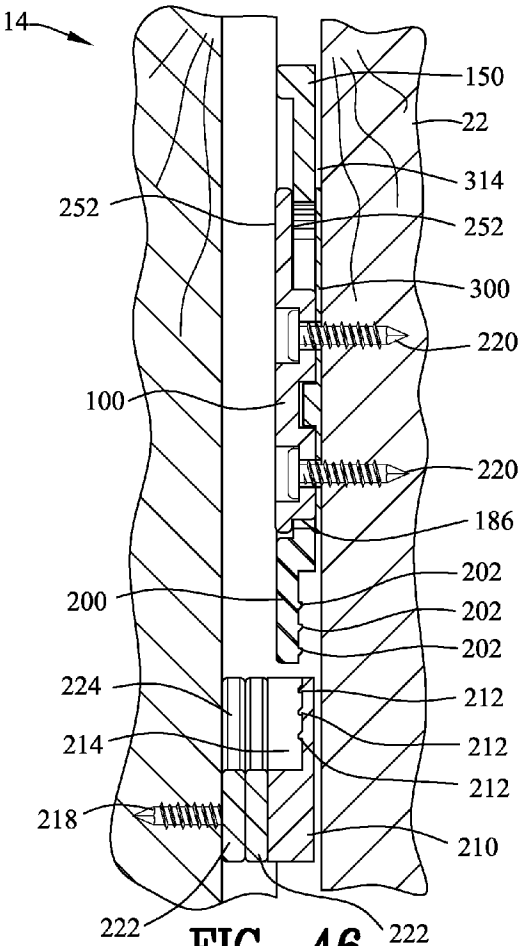
FIG. 46 is a sectional view along line 46-46 in FIG. 45.
Figure 45:
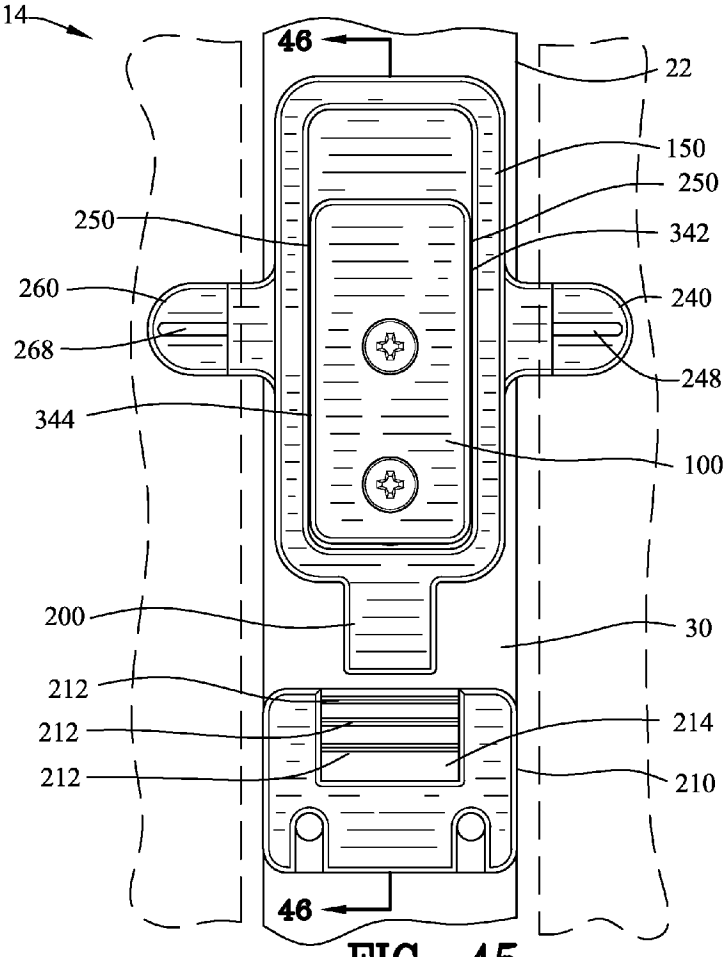
FIG. 45 is a front view of the third embodiment of FIG. 36 secured to a pocket door as shown in FIG. 2.
Figure 48:
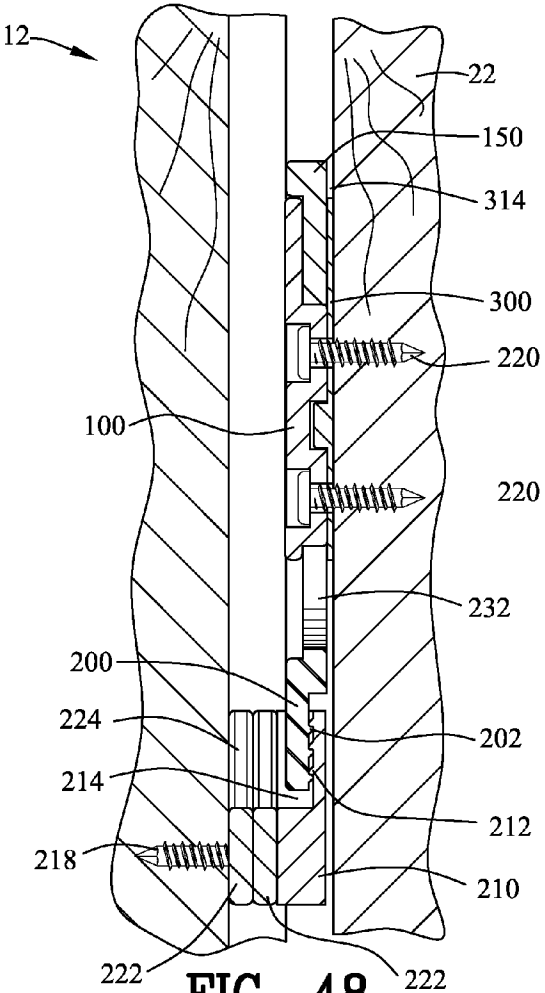
FIG. 48 is a sectional view along line 48-48 in FIG. 47.
Figure 47:
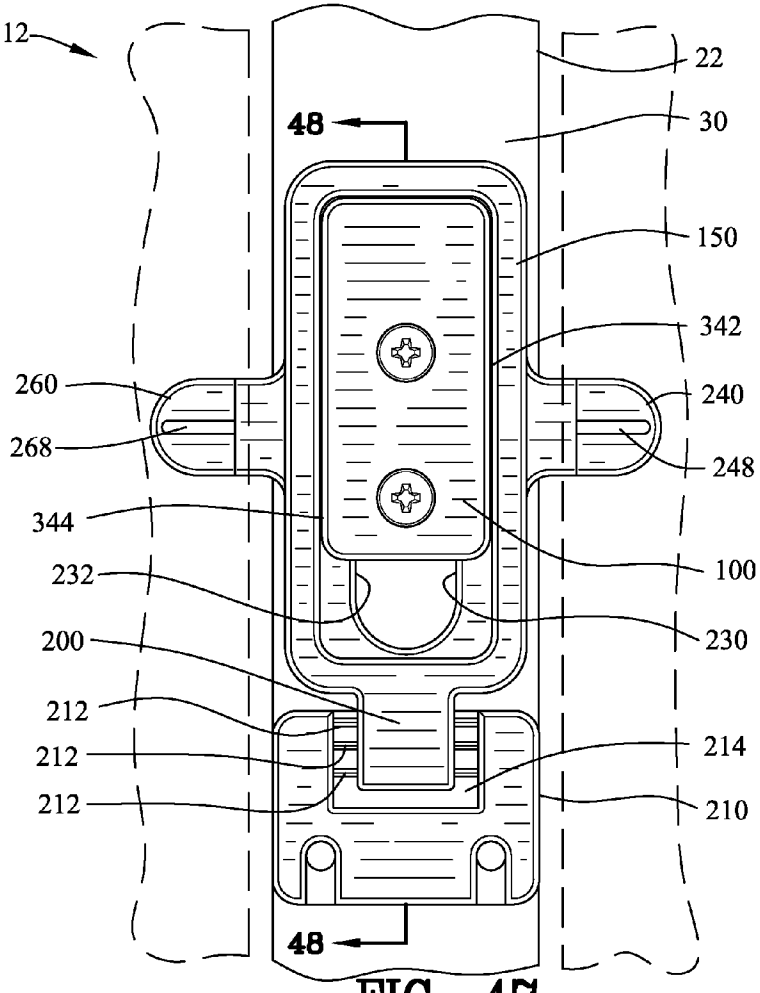
FIG. 47 is a front view of the third embodiment of FIG. 36 secured to a pocket door as shown in FIG. 3.

As best shown in FIG. 36, the cushioning material 272 may include a first disk cushioning pad 290 and a second disk cushioning pad 292 secured to the third extension portion 246 and the sixth extension portion 266 respectively. The first disk cushioning pad 290 and the second disk cushioning pad 292 may be secured by a first disk adhesive pad 294 and a second disk adhesive pad 296 respectively. Alternatively, the first disk cushioning pad 290 and the second disk cushioning pad 296 may be secured by other means including glue, mechanical fasteners or other means. As noted above, the first disk cushioning pad 290 and the second disk cushioning pad 292 reduce the impact force between the first handle 240 and the second handle 260 and the second side jamb 46. The first disk cushioning pad 290 and the second disk cushioning pad 292 may include a natural or non-natural elastomer, foam or other depressive old materials.

The third embodiment of the slide lock device 10 as shown in FIGS. 36-48 eliminates the preventer finger 350 and the finger rib 352 from the mounting plate 100. In the third embodiment of the slide lock device 10, a first frictional force 250 is present between the primary side surface 110 of the mounting plate 100 and the primary inner side surface 338 of the latch recess 330 and between the secondary side surface 112 of the mounting plate 100 and the secondary inner side surface 340 of the latch recess 330. The first frictional force 250 maintains the latch plate 150 in the upper position or the non-locking position 14 and prevents inadvertent contact between the upper stop surface 122 of the guide track 120 and the upper termination surface 172 of the track groove 170.

The third embodiment of the slide lock device 10 also includes a second frictional force 252 that is present between the spacer plate 300 and the interior plate surface 152 of the latch plate 150 and between the mounting plate 100 and the recess surface 332 of the latch plate 150. The second frictional force 252 maintains the latch plate 150 in the upper position or the non-locking position 14 and prevents inadvertent contact between the upper stop surface 122 of the guide track 120 and the upper termination surface 172 of the track groove 170.

Upon a descending force applied to the latch plate 150 that is greater than the first frictional force 250 and the second frictional force 252, the latch plate 150 may be displace in a descending direction for positioning the latch plate 150 in the locking position 12.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A slide lock device for preventing a panel from being displaced from an opening within a surrounding structure, the panel having an interior side, an exterior side, a top edge, a first side edge and a second side edge, the surrounding structure having a top structure, first side structure and a second side structure for defining the opening, a couple securing the panel to the surrounding structure for displacing the panel relative to the opening, the slide lock device, comprising:

a mounting plate having an interior plate surface, an exterior plate surface, an upper edge, a lower edge, a primary side surface and a secondary side surface;

a guide track extending from said interior plate surface of said mounting plate and having an upper stop surface, a lower stop surface, a first side track surface and a second side track surface;

a latch plate having an interior plate surface, an exterior plate surface, an upper edge, a lower edge, a primary side surface and a secondary side surface;

a track groove extending between said interior plate surface of said latch plate and said exterior plate surface of said latch plate and having a upper termination surface, a lower termination surface, a first side groove surface and a second groove surface;

a bolt extending from said lower edge of said latch plate;

a bolt receiver coupled to said first side structure of the surrounding structure;

a fastener traversing said mounting plate, said track groove and into the first side edge of the panel for positioning said guide track into said track groove and slidably coupling said latch plate to the panel;

said lower stop surface of said guide track adjacent to said lower termination surface of said track groove for defining a non-locking position wherein said bolt may not engage with said bolt receiver for permitting displacement of the panel relative to the opening;

said upper stop surface of said guide track adjacent to said upper termination surface of said track groove for defining a locking position therein said bolt engaging with said bolt receiver upon said latch plate aligning with said bolt receiver for preventing the displacement of the panel relative to the opening;

said first side track surface of said guide track adjacent to said first side groove surface of said track groove for defining a first slide guide;

said second side track surface of said guide track adjacent to said second side groove surface of said track groove for defining a second slide guide;

said first slide guide and said second slide guide slidably channeling the transition of said latch plate between said non-locking position and said locking position;

a first handle extending from said primary side surface of said latch plate for manipulating said latch plate between said non-locking position and said locking position from the interior side of the panel; and a second handle extending from said secondary side surface of said latch plate for manipulating said latch plate between said non-locking position and said locking position from the exterior side of the panel.

2. A slide lock device as set forth in claim 1, wherein said first handle includes a first extension portion extending from said latch plate and oriented parallel to said latch plate, a second extension portion extending from said first extension portion and oriented perpendicular to said latch plate and a third extension portion extending from said second extension portion and oriented parallel to said latch plate; and said second handle includes a fourth extension portion extending from said latch plate and oriented parallel to said latch plate, a fifth extension portion extending from said fourth extension portion and oriented perpendicular to said latch plate and a sixth extension portion extending from said fifth extension portion and oriented parallel to said latch plate.

3. A slide lock device as set forth in claim 1, further including a spacer plate having an interior plate surface, an exterior plate surface, an upper edge, a lower edge, a primary side surface and a secondary side surface;

said fastener traversing said mounting plate, said track groove, said spacer plate and into the first side edge of the panel for positioning said guide track into said track groove and slidably coupling said latch plate to the panel; and said spacer plate distancing said latch plate from the first side edge of the panel for defining an elongated slot therebetween.

4. A slide lock device as set forth in claim 1, further including a latch recess extending from said exterior plate surface of said latch plate having an recess surface, an upper edge, a lower edge, a primary inner side surface and a secondary inner side surface; and said latch recess receiving said mounting plate for aligning said exterior plate surface of said latch plate with said exterior plate surface of said mounting plate and reducing the thickness of the slide lock device.

5. A slide lock device as set forth in claim 1, further including a latch recess extending from said exterior plate surface of said latch plate having an recess surface, an upper edge, a lower edge, a primary inner side surface and a secondary inner side surface;

said lower edge of said mounting plate adjacent to said lower edge of said latch recess for positioning said latch plate in said non-locking position;

said upper edge of said mounting plate adjacent to said upper edge of said latch recess for positioning said latch plate in said locking position;

said primary side surface of said mounting plate adjacent to said primary inner side surface of said latch recess for defining a third slide guide;

said secondary side surface of said mounting plate adjacent to said secondary inner side surface of said latch recess for defining a fourth slide guide; and said third slide guide and said fourth slide guide slidably channeling the transition of said latch plate between said non-locking position and said locking position.

6. A slide lock device as set forth in claim 1, further including a bolt rib coupled to said bolt;

a receiver rib coupled to said bolt receiver; and said bolt rib passing over said receiver rib in said locking position for preventing inadvertent removal of said bolt from the bolt receiver.

7. A slide lock device for preventing a pocket door from being displaced from an opening within a wall, the pocket door having an interior side, an exterior side, a top edge, a first side edge and a second side edge, the wall having a top jamb, first side jamb and a second side jamb for defining the opening, the first side jamb having an interior jamb molding and an exterior jamb molding for defining a jamb elongated groove, a carriage slidably coupling the top edge of the pocket door with the top jamb for displacing the pocket door relative to the opening, the slide lock device, comprising:

a mounting plate having an interior plate surface, an exterior plate surface, an upper edge, a lower edge, a primary side surface and a secondary side surface;

a guide track extending from said interior plate surface of said mounting plate and having an upper stop surface, a lower stop surface, a first side track surface and a second side track surface;

a latch plate having an interior plate surface, an exterior plate surface, an upper edge, a lower edge, a primary side surface and a secondary side surface;

a track groove extending between said interior plate surface of said latch plate and said exterior plate surface of said latch plate and having a upper termination surface, a lower termination surface, a first side groove surface and a second groove surface;

a bolt extending from said lower edge of said latch plate;

a bolt receiver coupled between the exterior jamb molding and the interior jamb molding and within the jamb elongated groove;

a fastener traversing said mounting plate, said track groove and into the first side edge of the pocket door for positioning said guide track into said track groove and slidably coupling said latch plate to the pocket door;

said lower stop surface of said guide track adjacent to said lower termination surface of said track groove for defining a non-locking position wherein said bolt may not engage with said bolt receiver for permitting displacement of the pocket door relative to the opening;

said upper stop surface of said guide track adjacent to said upper termination surface of said track groove for defining a locking position therein said bolt engaging with said bolt receiver upon said latch plate aligning with said bolt receiver for preventing the displacement of the pocket door relative to the opening;

said first side track surface of said guide track adjacent to said first side groove surface of said track groove for defining a first slide guide;

said second side track surface of said guide track adjacent to said second side groove surface of said track groove for defining a second slide guide;

said first slide guide and said second slide guide slidably channeling the transition of the latch plate between said non-locking position and said locking position;

a first handle extending from said primary side surface of said latch plate for manipulating said latch plate between said non-locking position and said locking position from the interior side of the pocket door; and a second handle extending from said secondary side surface of said latch plate for manipulating said latch plate between said non-locking position and said locking position from the exterior side of the pocket door.

8. A slide lock device as set forth in claim 7, wherein said first handle includes a first extension portion extending from said latch plate and oriented parallel to said latch plate, a second extension portion extending from said first extension portion and oriented perpendicular to said latch plate and a third extension portion extending from said second extension portion and oriented parallel to said latch plate;

said first extension portion positioning said first handle beyond the first side edge of the pocket door;

said second extension portion positioning said first handle beyond the interior jamb molding of the first side jamb;

said third extension portion positioning said first handle beyond the interior side of the pocket door;

said second handle includes a fourth extension portion extending from said latch plate and oriented parallel to said latch plate, a fifth extension portion extending from said fourth extension portion and oriented perpendicular to said latch plate and a sixth extension portion extending from said fifth extension portion and oriented parallel to said latch plate;

said fourth extension portion positioning said second handle beyond the first side edge of the pocket door;

said fifth extension portion positioning said second handle beyond the exterior jamb molding of the first side jamb; and said sixth extension portion positioning said second handle beyond the exterior side of the pocket door.

9. A slide lock device as set forth in claim 7, further including a spacer plate having an interior plate surface, an exterior plate surface, an upper edge, a lower edge, a primary side surface and a secondary side surface;

said fastener traversing said mounting plate, said track groove, said spacer plate and into the first side edge of the pocket door for positioning said guide track into said track groove and slidably coupling said latch plate to the pocket door; and said spacer plate distancing said latch plate from the first side edge of the pocket door for defining an elongated slot therebetween.

10. A slide lock device as set forth in claim 7, further including a latch recess extending from said exterior plate surface of said latch plate having an recess surface, an upper edge, a lower edge, a primary inner side surface and a secondary inner side surface; and said latch recess receiving said mounting plate for aligning said exterior plate surface of said latch plate with said exterior plate surface of said mounting plate and reducing the thickness of the slide lock device.

11. A slide lock device as set forth in claim 7, further including a latch recess extending from said exterior plate surface of said latch plate having an recess surface, an upper edge, a lower edge, a primary inner side surface and a secondary inner side surface;

said lower edge of said mounting plate adjacent to said lower edge of said latch recess for positioning said latch plate in said non-locking position;

said upper edge of said mounting plate adjacent to said upper edge of said latch recess for positioning said latch plate in said locking position;

said primary side surface of said mounting plate adjacent to said primary inner side surface of said latch recess for defining a third slide guide;

said secondary side surface of said mounting plate adjacent to said secondary inner side surface of said latch recess for defining a fourth slide guide; and said third slide guide and said fourth slide guide slidably channeling the transition of said latch plate between said non-locking position and said locking position.

12. A slide lock device as set forth in claim 7, further including a bolt rib coupled to said bolt;

a receiver rib coupled to said bolt receiver; and said bolt rib passing over said receiver rib in said locking position for preventing inadvertent removal of said bolt from the bolt receiver.

13. A slide lock device for preventing a panel from being displaced from an opening within a surrounding structure, the panel having an interior side, an exterior side, a top edge, a first side edge and a second side edge, the surrounding structure having a top structure, first side structure and a second side structure for defining the opening, a couple securing the panel to the surrounding structure for displacing the panel relative to the opening, the slide lock device, comprising:

a mounting plate having an interior plate surface, an exterior plate surface, an upper edge, a lower edge, a primary side surface and a secondary side surface;

a guide track extending from said interior plate surface of said mounting plate;

a latch plate having an interior plate surface, an exterior plate surface, an upper edge, a lower edge, a primary side surface and a secondary side surface;

a track groove extending between said interior plate surface of said latch plate and said exterior plate surface of said latch plate;

a bolt extending from said lower edge of said latch plate;

a bolt receiver coupled to said first side structure of the surrounding structure;

a fastener traversing said mounting plate, said track groove and into the first side edge of the panel for positioning said guide track into said track groove and slidably coupling said latch plate to the panel;

said guide track and track groove defining a slide guide;

said slide guide slidably channeling the transition of said latch plate between said non-locking position and said locking position;

a first handle extending from said primary side surface of said latch plate for manipulating said latch plate between said non-locking position and said locking position from the interior side of the panel; and a second handle extending from said secondary side surface of said latch plate for manipulating said latch plate between said non-locking position and said locking position from the exterior side of the panel.

* * * * *